US011670902B2

(12) United States Patent
Weber et al.

(10) Patent No.: US 11,670,902 B2
(45) Date of Patent: Jun. 6, 2023

(54) ALIGNING METHOD FOR CABLE PROCESSING APPARATUS

(71) Applicant: komax Holding AG, Dierikon (CH)

(72) Inventors: Bruno Weber, Ballwil (CH); Dominik Feubli, Kriens (CH); Alois Conte, Ebikon (CH); Nils Furrer, Thalwil (CH)

(73) Assignee: komax Holding AG, Dierikon (CH)

( * ) Notice: Subject to any disclaimer, the term of this patent is extended or adjusted under 35 U.S.C. 154(b) by 0 days.

(21) Appl. No.: 17/888,202

(22) Filed: Aug. 15, 2022

(65) Prior Publication Data

US 2022/0393418 A1 Dec. 8, 2022

Related U.S. Application Data

(62) Division of application No. 16/626,944, filed as application No. PCT/EP2017/066341 on Jun. 30, 2017, now Pat. No. 11,451,000.

(51) Int. Cl.
*H01R 43/048* (2006.01)
*H01R 43/058* (2006.01)

(52) U.S. Cl.
CPC ..... *H01R 43/048* (2013.01); *H01R 43/058* (2013.01)

(58) Field of Classification Search
CPC ..... H01R 43/048; H01R 43/058
(Continued)

(56) References Cited

U.S. PATENT DOCUMENTS 5,794,333 A 8/1998 Shea
8,322,697 B2 12/2012 Lin
(Continued)

FOREIGN PATENT DOCUMENTS

DE 20 2011 107 870 U1 2/2013
DE 202011107870 U1 * 4/2013 ..... H01R 43/055
(Continued)

OTHER PUBLICATIONS

International Search Report of PCT/EP2017/066343, dated Dec. 1, 2017.
(Continued)

*Primary Examiner* — Peter G Leigh
(74) *Attorney, Agent, or Firm* — Collard & Roe, P.C.

(57) ABSTRACT

A method aligns a crimping cassette crimping tool in a cable processing apparatus having a tensioning device for applying tension to a mounting part relative to a crimping device attachment surface. The crimping cassette includes the crimping tool having cooperating stationary and movable tool parts for crimping and a holding device that attaches to the mounting part fixed to the stationary tool part and has a position allowing a spatially-limited adjustment movement of the stationary tool part. The method includes releasing the tensioning device; inserting the stationary tool part into a tensioning device area; moving the moveable tool part towards the stationary tool part slightly before it touches the stationary tool part; moving the moveable tool part towards the stationary tool part until a pressing force between the tool parts is reached or exceeded and an alignment occurs between the tool parts; and applying tension with the tensioning device.

16 Claims, 27 Drawing Sheets

(58) Field of Classification Search
USPC ..... 72/413
See application file for complete search history.

(56) References Cited

U.S. PATENT DOCUMENTS

| | | | | |
|---|---|---|---|---|
| 9,373,924 | B2 | 6/2016 | Fischer | |
| 2004/0007042 | A1 | 1/2004 | Imgrut et al. | |
| 2008/0168653 | A1 | 7/2008 | Chikyu | |
| 2014/0150260 | A1 | 6/2014 | Fischer | |
| 2016/0294142 | A1* | 10/2016 | Fischer | H01R 43/048 |
| 2017/0317459 | A1* | 11/2017 | Imgrüt | H01R 43/055 |

FOREIGN PATENT DOCUMENTS

| | | | | |
|---|---|---|---|---|
| EP | 1341269 | A1 * | 9/2003 | H01R 43/048 |
| EP | 1 381 123 | A1 | 1/2004 | |
| EP | 2738886 | A1 * | 6/2014 | H01R 43/048 |
| EP | 2738886 | A1 | 6/2014 | |
| EP | 3 240 123 | A1 | 11/2017 | |
| JP | 2004-111264 | A | 4/2004 | |
| JP | 2012153509 | A | 8/2012 | |
| WO | 2006/136930 | A1 | 12/2006 | |
| WO | 2015/171845 | A2 | 11/2015 | |

OTHER PUBLICATIONS

Written Opinion of the International Searching Authority of PCT/EP2017/066343, dated Dec. 1, 2017.
International Preliminary Report on Patentability of PCT/EP2017/066343, dated Oct. 7, 2019.
Written Opinion of the International Preliminary Examining Authority of PCT/EP2017/066343, dated May 31, 2019.
International Search Report of PCT/EP2017/066341, dated Dec. 1, 2017.
Written Opinion of the International Searching Authority of PCT/EP2017/066341, dated Dec. 1, 2017.
International Preliminary Report on Patentability of PCT/EP2017/066341, dated Oct. 7, 2019.
Written Opinion of the International Preliminary Examining Authority of PCT/EP2017/066341, dated Jun. 25, 2019.
Letter to European Patent Office dated Apr. 25, 2019 regarding PCT/EP2017/066341.

* cited by examiner

ALIGNING METHOD FOR CABLE PROCESSING APPARATUS

CROSS REFERENCE TO RELATED APPLICATIONS

This application is a divisional patent application and claims priority under 35 U.S.C. § 120 and 35 U.S.C. § 121 of U.S. patent application Ser. No. 16/626,944 filed Dec. 27, 2019 which is the National Stage of PCT/EP2017/066341 filed on Jun. 30, 2017, the disclosures of which are incorporated by reference. The international application under PCT article 21 (2) was published in English.

BACKGROUND OF THE INVENTION

Technical Field

The present disclosure relates to a method of aligning a crimping tool of a crimping cassette in a cable processing apparatus.

Background Art

Cable processing apparatuses comprising a crimping device loadable with crimp cassettes are known in the art. A crimp cassette comprises part of a crimping tool, as well as a magazine (a reel) of crimp contacts or the like. The crimping tool part as a component of a crimp cassette can be arranged, typically automatically arranged, on the crimping device of the cable processing apparatus. Some crimping tools for crimping devices are divided, i. e. they have a stationary tool part and a movable tool part. The stationary and movable tool parts are configured to act together in a crimping operation of the crimping device.

The tool parts of a divided crimping tool can become misaligned, e. g. during a tool exchange operation. There is a desire to counteract such a misalignment which causes incorrect and/or unreliable crimps.

Document WO 2006/136930 A1 describes a crimping machine for different crimping and pressing processes having a crimping station that comprises a crimping tool. The crimping tool is formed in two parts.

Document US 2004/0007042 A1 describes a crimping press having a cassette that can be inserted from the rear of the press.

It is an object of the present disclosure to provide a method of aligning a crimp cassette in a cable processing apparatus having a crimping device loadable with the crimp cassette where positioning or alignment of the cassette inside the crimping device, as well as an alignment of the tools parts of a divided crimping tool, are improved.

SUMMARY OF THE INVENTION

In view of the above, a method according to the invention is provided. Further aspects, advantages, and features of the present disclosure are apparent from the description and the accompanying drawings. The aspects discussed below may be freely combined with each other, as appropriate.

According to one aspect of the disclosure, a crimping cassette for a crimping device of a cable processing apparatus has a crimping tool having a stationary tool part and a movable tool part, wherein the stationary and movable tool parts are configured to act together in a crimping operation of the crimping device. The crimping cassette further comprises a holding device for attaching to a mounting part, the mounting part being directly or indirectly fixed to the stationary tool part. The holding device has a position for allowing an adjustment movement of the stationary tool part within a spatially limited adjustment range. The holding device may comprise at least two claws for attaching to the mounting part in a mounting area of the claws. The position for allowing the adjustment movement of the stationary tool part within the spatially limited adjustment range may be referred to as an unlocked closed position, and the claws may loosely grip the mounting part in the unlocked closed position. The holding device may further have a locked closed position in which the claws are firmly clamped to the mounting part, and an open position in which the claws release the mounting part such that the stationary tool part is separable from the holding device.

In the locked position, the claws are firmly clamped to the mounting part of the mounting part. When in the unlocked closed position, the mounting part is not yet released in a manner which would allow a complete detachment of the stationary tool part. However, an adjustment of the stationary tool part relative to the movable tool part in a limited adjustment range is possible in the unlocked closed position. Hence, the movable and stationary tool parts are easily aligned relative to each other.

The adjustment range, typically in a plane which is perpendicular to a crimping operation movement of the movable tool part relative to the stationary tool part, is limited to a range which is sufficient for performing an efficient alignment operation, e. g. within a range, in the two directions of the plane, of less than 10 mm or less than 2 mm.

In the open position, the claws release the mounting part and allow the stationary tool part to be separated from the holding device. This allows for an easy exchange of the crimping cassette in a cable processing apparatus or by hand.

The cable processing apparatus further comprises a tensioning device for the mounting part adapted to apply a tensioning force to the mounting part relative to an attachment surface provided on the crimping device. Thereby, a reliable and tight fixation is possible.

According to the method of aligning a crimping tool of a crimping cassette in the cable processing apparatus (aligning method or alignment method), the method comprises releasing the tensioning device; inserting the stationary tool part of the crimping tool into a tensioning area of the tensioning device; moving the moveable tool part towards the stationary tool part slightly before the moveable tool part touches the stationary tool part; moving the moveable tool part towards the stationary tool part until a pressing force between the moveable tool part and the stationary tool part is reached or exceeded, such that an alignment within the adjustment range takes place between the moveable tool part and the stationary tool part; and applying a tension with the tensioning device.

The method may comprise—before releasing the tensioning device—bringing the holding device in the unlocked closed position; and—before moving the moveable tool part towards the stationary tool part until a pressing force between the moveable tool part and the stationary tool part is reached or exceeded, such that an alignment within the adjustment range takes place between the moveable tool part and the stationary tool part—bringing the holding device into the open position. The method may further comprise—as a final step—bringing the holding device into the locked closed position.

According to certain aspects of the embodiment, the attachment surface is provided with at least one supporting element, typically supporting roller, adapted to lower a friction between the mounting part and the attachment surface. Thereby, a movement of the mounting part on the attachment surface, prior to tightening and/or after releasing, is facilitated.

In embodiments, a closing spring is provided and arranged such as to close the gripping of the claws in the unlocked closed position. In other words: The closing spring acts on the claws to keep a sufficient clamping force, in the unlocked closed position, to prevent a premature release of the stationary tool part from the holding device, yet allowing for an efficient alignment operation.

In embodiments, the crimping tool is configured to perform a tool part alignment operation in which, when the holding device is in the unlocked closed position, the movable tool part is moved towards the stationary tool part, typically to a greater extent than when performing a crimping operation, such as to mechanically shift the stationary tool part within the spatially limited adjustment range.

Corresponding shapes of the surfaces of the movable and stationary tool parts which are involved in such an alignment operation may be beneficially shaped to ensure a reliable alignment. Hence, the movable tool part and the stationary tool part may each comprise an alignment face, wherein the alignment faces are shaped such as to interact in the tool part alignment operation to self-align the stationary tool part relative to the movable tool part.

In embodiments, the holding device further comprises a mandrel. The mandrel has a back face shaped such that when it is pushed against a corresponding face of the claws, the claws are tightened, in the mounting area, to the mounting part; and a front face shaped such that when it is pushed against a corresponding face of the claws, the claws are spread.

The mandrel is moveable into an idle state in which none of the back face or the front face pushes against the claws to facilitate a tool part alignment operation in the unlocked closed position of the holding device. Hence, in the idle state, the mandrel does not hinder an aligning movement of the stationary tool part relative to the movable tool part.

In embodiments, the crimping cassette further comprises an operating device adapted to operate the holding device at least between the locked closed position and the unlocked closed position.

The operating device may comprise an unlocking push button and an unlocking lever coupled to each other. A linear movement of the unlocking push button may be transformed, via the unlocking lever, into a linear movement of the mandrel into the idle state. Then, an alignment operation is easily possible.

In embodiments, the crimping tool further comprises a coupling device for releasably coupling the movable tool part with the stationary tool part. The coupling device may be fixed to the movable tool part. The coupling device may comprise a conical end face which is adapted to be engaged with a corresponding conical bore provided on the stationary tool part.

In embodiments relating to the cable processing apparatus, the cable processing apparatus further comprises a locking device for releasably locking a loaded crimping cassette. The locking device is configured to operate the operating device of the crimping cassette.

In embodiments, the cable processing apparatus further comprises a mounting device configured to mount the moveable tool part of the crimping tool of a loaded crimping cassette.

In embodiments, the mounting device comprises a gripper which is configured and arranged to be moveable according to a gripping trajectory to grip a gripping counterpart of the moveable tool part, the gripping trajectory comprising, in a movement of the gripper to grip the gripping counterpart, a linear trajectory and a subsequent pivoting trajectory.

With a succession of a linear trajectory and a pivoting trajectory, an automated fixation and alignment operation of the tool parts relative to each other is further facilitated.

In embodiments, the gripper is arranged and shaped such as to be moved according the gripping trajectory upon applying a force to an operating face of the gripper. The force has a constant direction throughout the movement of the gripper according to the gripping trajectory. According to a further aspect, the cable processing apparatus further comprises an actuator, typically a pneumatic cylinder, to open the gripper, and a spring arrangement to close the gripper.

Thereby, with a simple linear arrangement of actuators and/or spring elements, a reliable gripping operation, involving an advanced trajectory, is possible by acting on a single face of the gripper.

In embodiments, the cable processing apparatus further comprises a lifting device adapted to lift the moveable tool part towards the mounting device. However, according to an alternative embodiment, the mounting device itself may be moveable towards the moveable tool part.

In embodiments, the cable processing apparatus further comprises a pressure detector arranged to detect a pressing force between the movable tool part and the stationary tool part, and a stroke limiting device connected to the pressure detector, wherein the stroke limiting device is adapted to limit a stroke of the movable tool part relative to the stationary tool part upon detection of a pressing force which exceeds a predetermined maximum pressing force.

According to an aspect of the disclosure, prior to the alignment method above, a loading method of the crimping cassette in the cable processing apparatus may be performed.

The loading method comprises moving the locking device towards the crimping cassette to be loaded; operating the operating device to bring the holding device into the unlocked closed position; attaching the crimping cassette to the locking device; releasing the moveable tool part from the stationary tool part; moving the moveable tool part relative to the mounting device such as to approach the moveable tool and the mounting device; and gripping the gripping counterpart of the moveable tool part.

With the aspects and embodiments described herein, a crimping device such as a crimping press may perform any or all of the functions of lateral insertion of a crimping cassette with an intermediate position; opening a coupling device between the movable and stationary tool parts; taking over and holding the movable tool part, e. g. on a slide of the crimping device; opening the holding device in two stages (the unlocked closed position and the open position), and taking over the stationary tool part into the crimping device; aligning the tool parts, optionally by moving the tool parts together; and clamping the stationary tool part on the crimping device.

BRIEF DESCRIPTION OF THE DRAWINGS

The subject matter of the disclosure will be explained in more detail with reference to preferred exemplary embodiments which are illustrated in the accompanying drawings. In the drawings, like reference numerals are assigned to like or corresponding parts.

In the drawings.

DETAILED DESCRIPTION OF THE EMBODIMENTS

Figure 1:
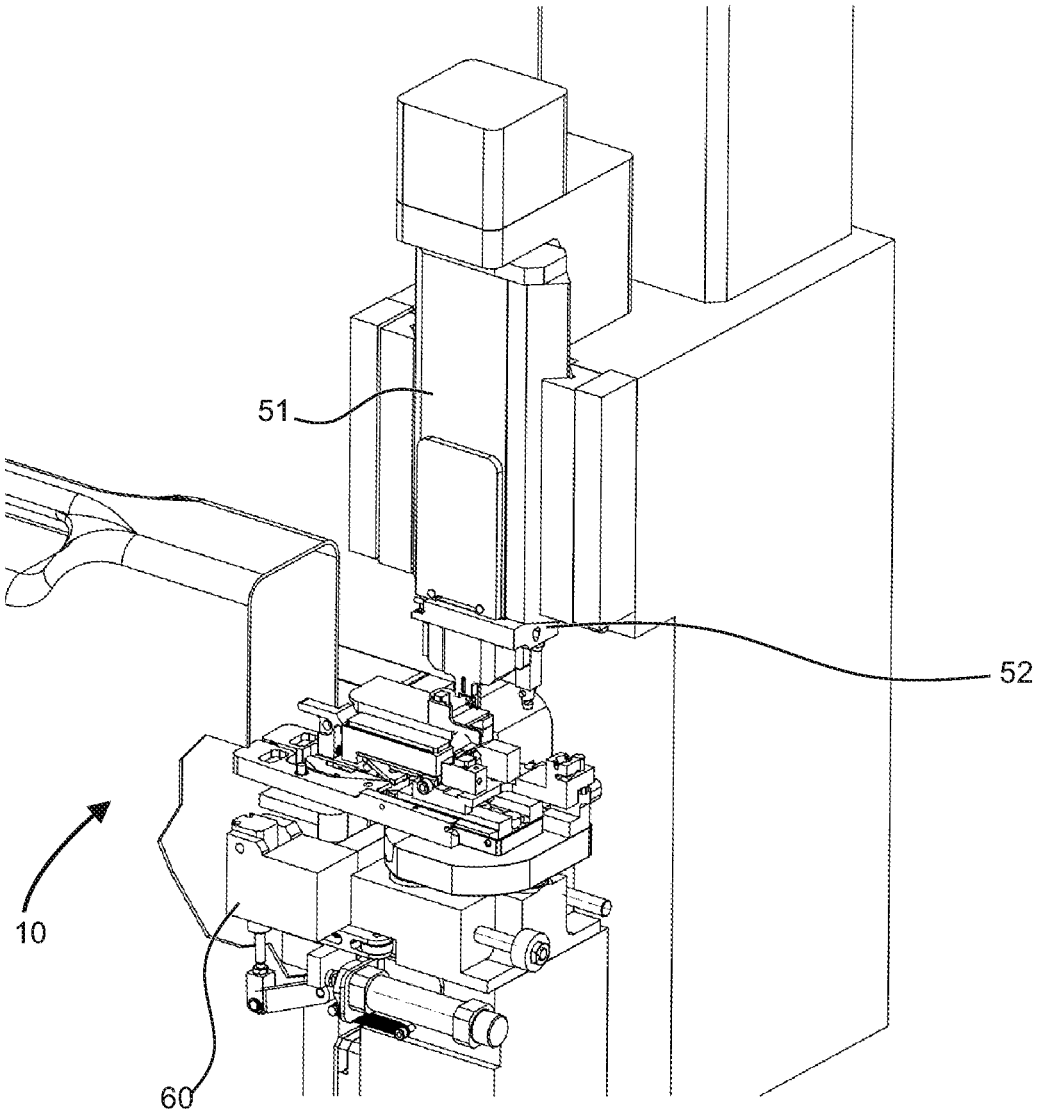
FIG. 1 is a perspective view of a crimping cassette and a crimping device of a cable processing apparatus used in an embodiment of the present disclosure.

FIG. 1 is a perspective view of a crimping cassette 10 and a crimping device 50 of a cable processing apparatus used in an embodiment of the present disclosure.

The crimping device comprises a mounting device 51 and a lifting device. In FIG. 1, the mounting device 51 is configured as a press slide, and the lifting device is configured as a lifting fork 52. A locking device 60 is provided on the crimping device for releasably locking a loaded crimping cassette 10, as described in more detail below.

Figure 2:
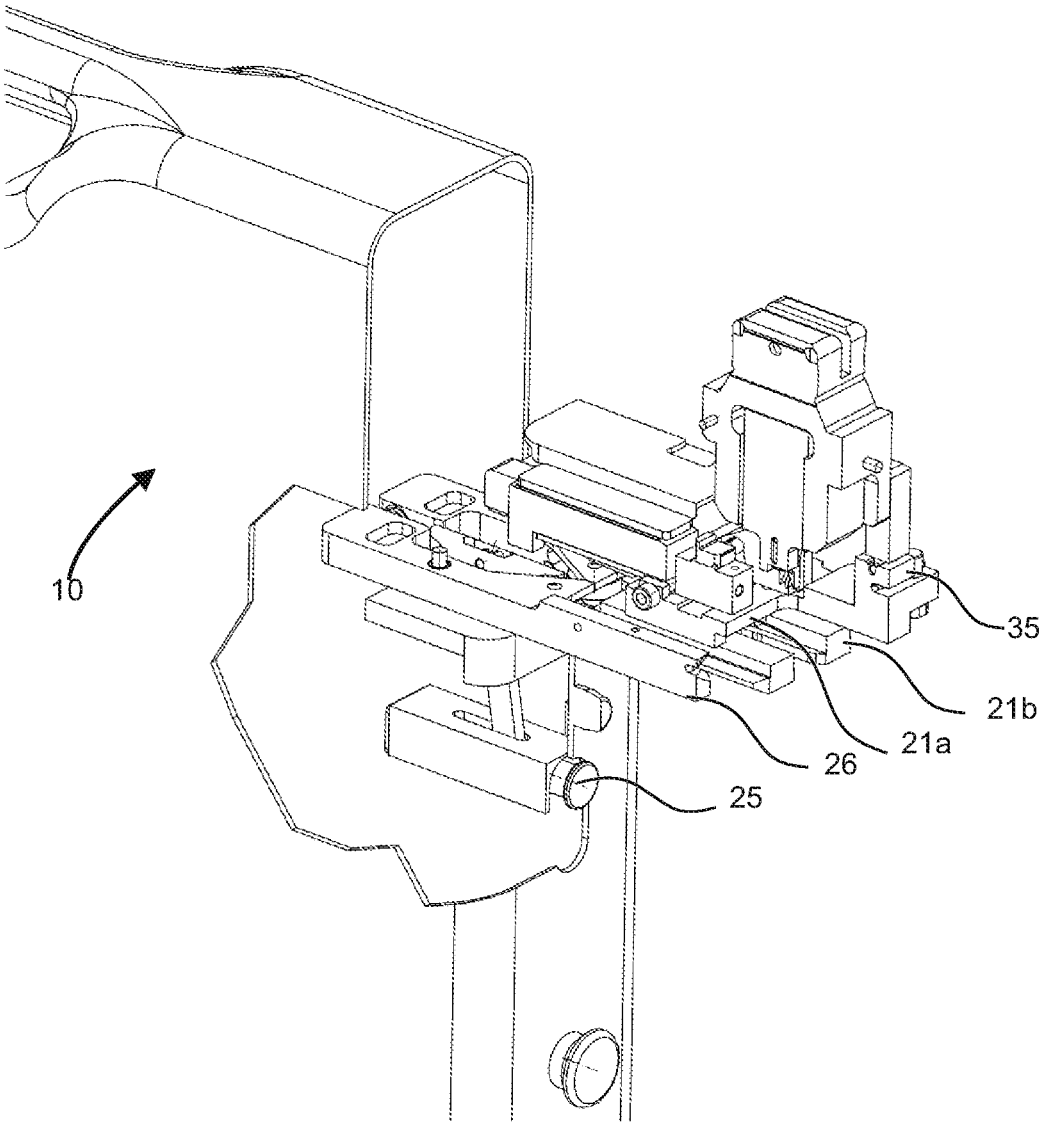
FIG. 2 is a close-up view of parts of FIG. 1.

In FIG. 2 which is a close-up view of FIG. 1, a holding device of the crimping cassette 10 is shown in more detail. The holding device comprises a bracket having two claws 21*a*, 21*b* which are normally pushed together, via a spring to be described further below, into a clamping position or locked position. An unlocking push button 25 is coupled to an unlocking lever 26 to release the claws 21*a*, 21*b* and described in more detail below.

Figure 18:
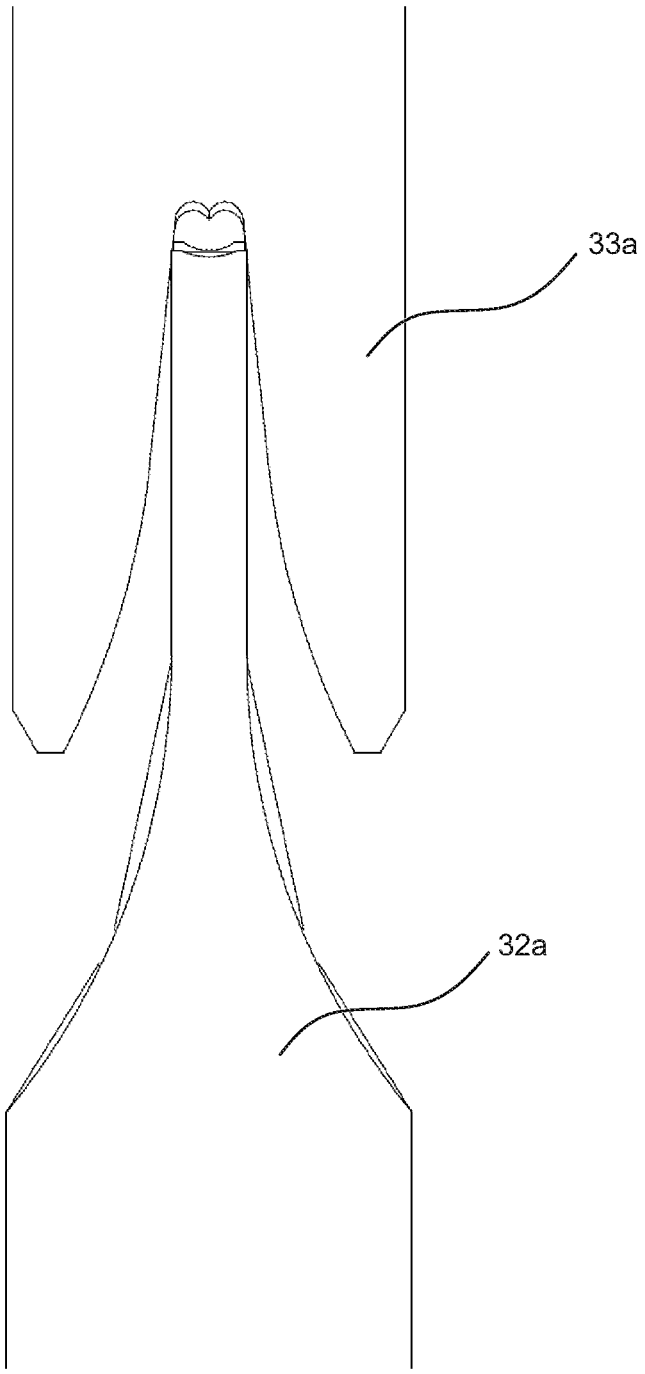
FIG. 18 shows alignment faces of upper and lower tool parts of the crimping cassette.

A crimping tool assembly comprises a base plate 31 on which a stationary crimp tool part 32 is fixed. The claws 21*a*, 21*b* clamp the base plate 31. Furthermore, the crimping tool assembly comprises a coupling 35 which is configured such that a movable crimping tool part can be releasably coupled to the stationary crimp tool part. The crimp tool parts 31 comprise a crimp anvil and a crimp indentor, respectively (see also FIG. 18). In order to protect the sensitive crimp anvil 32*a* and crimp indentor 33*a*, the stationary and movable tool parts are shifted in a lateral direction.

Figure 3:
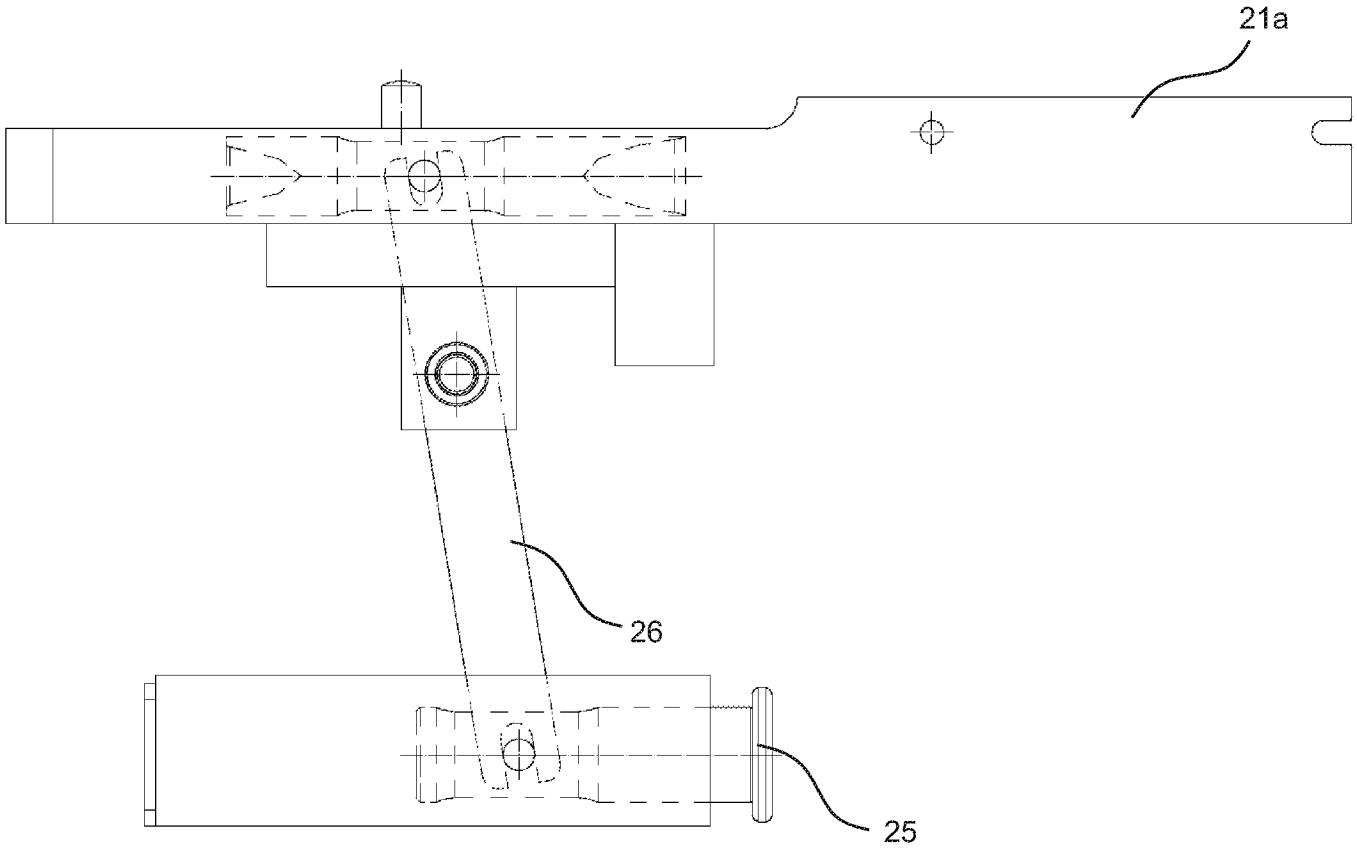
FIG. 3 is a schematic side view of a holding device.
Figure 4:
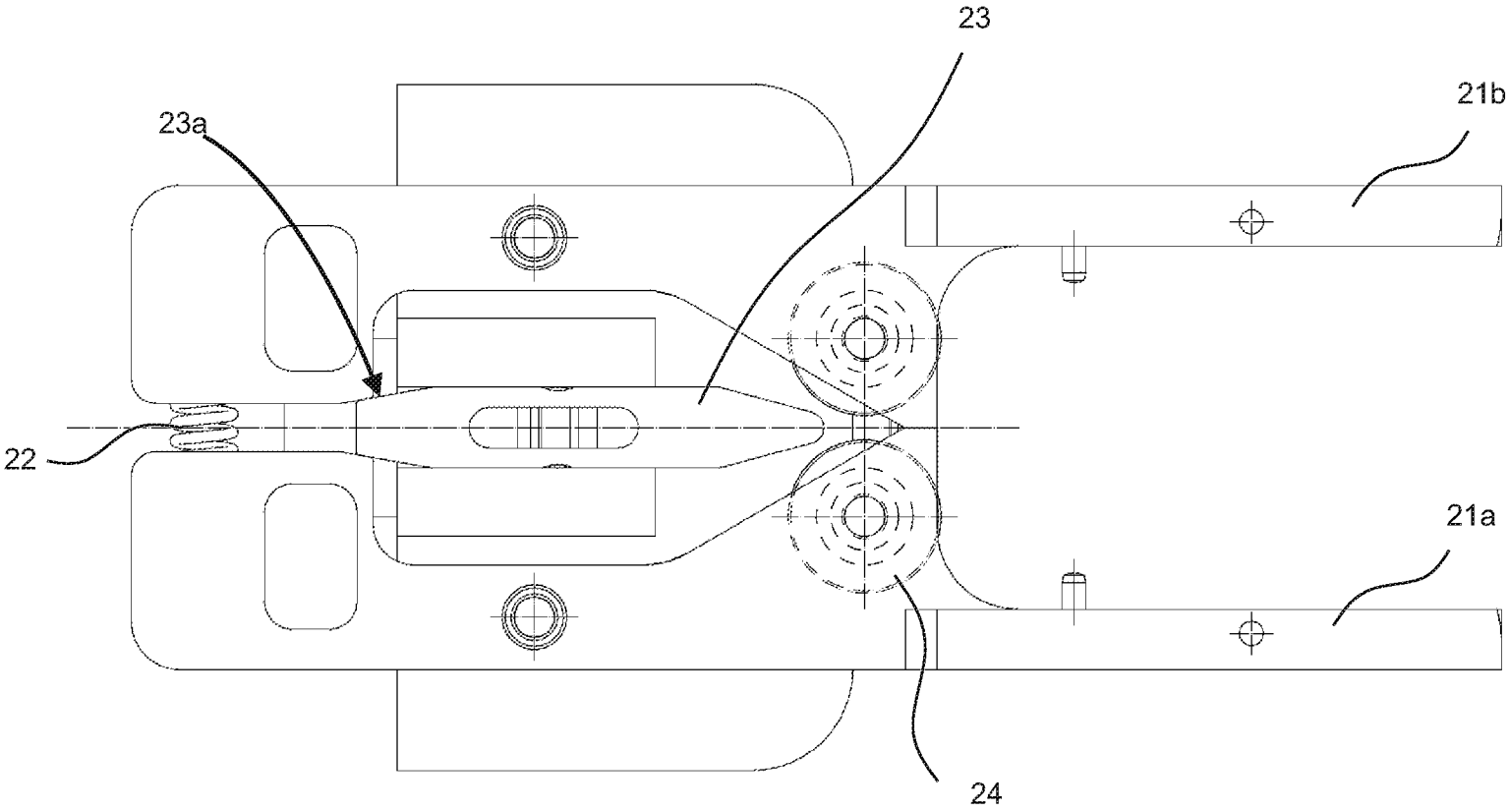
FIG. 4 is a schematic top view of a holding device in a locked position.
Figure 5:
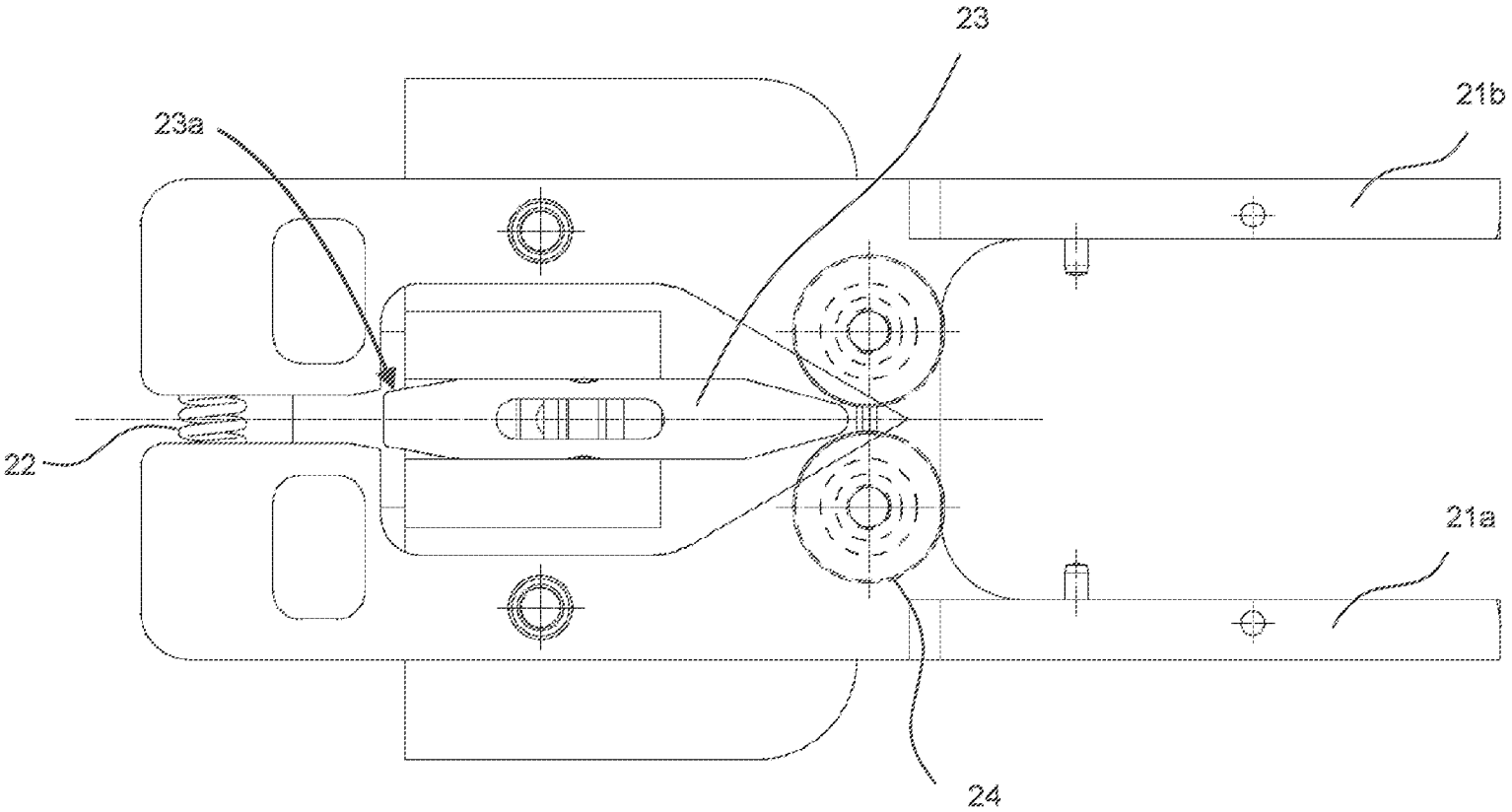
FIG. 5 is a schematic top view of a holding device in an unlocked closed position.
Figure 6:
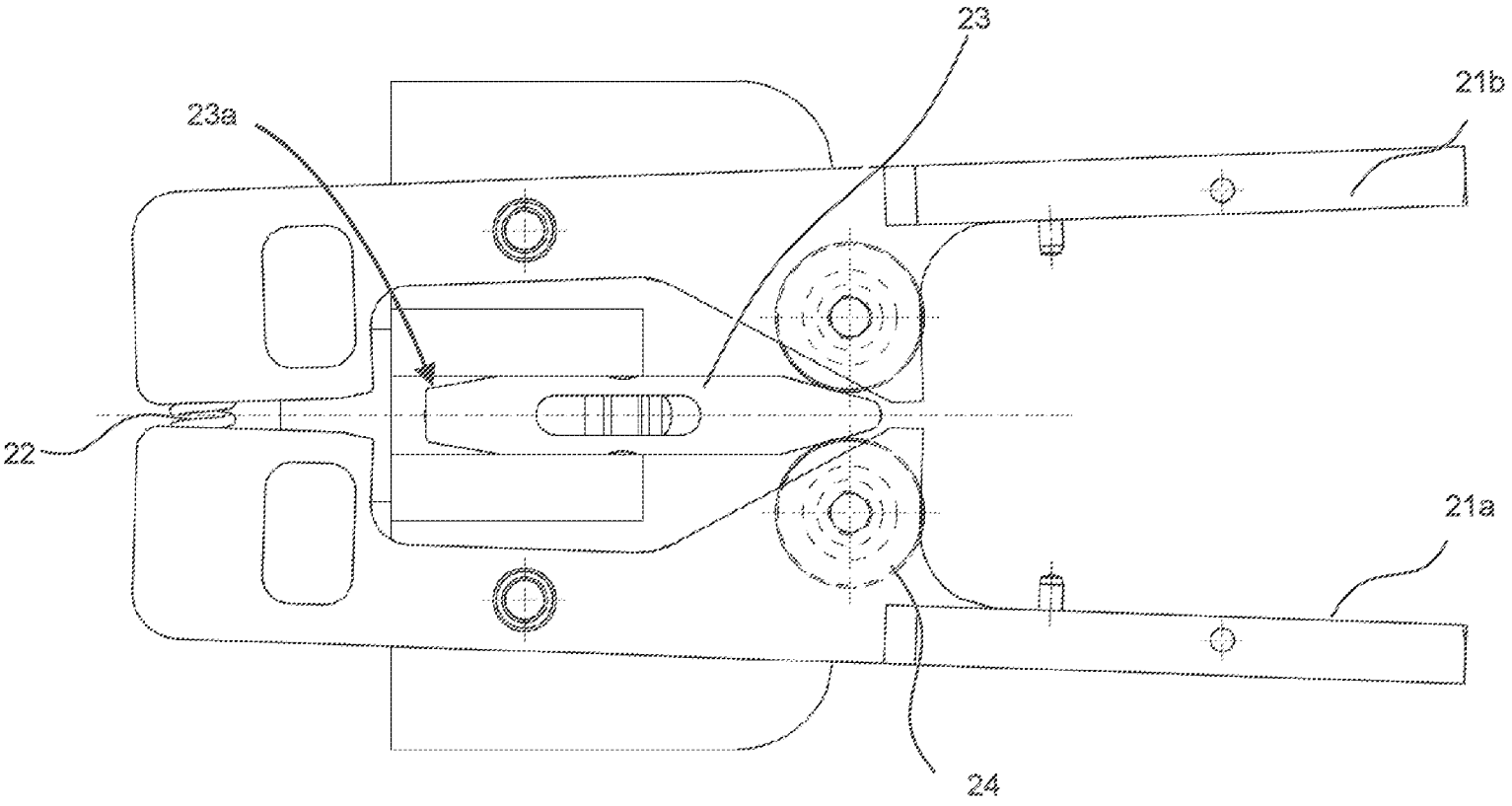
FIG. 6 is a schematic top view of a holding device in an open position.

FIG. 3 shows a schematic side view of the holding device. Corresponding schematic top views of the holding device in a locked position, in an unlocked closed position, and in an open position are respectively shown in FIGS. 4 to 6.

In the locked position and in the unlocked closed position, the claws 21*a*, 21*b* are pushed into a clamping or closed state by a closing spring 22. In the locked position (FIG. 4), the claws 21*a*, 21*b* are firmly clamped to a mounting part of the base plate. In the unlocked closed position (FIG. 5), the claws 21*a*, 21*b* loosely grip the mounting part for allowing an adjustment movement of the stationary tool part within a spatially limited adjustment range. In the open position (FIG. 6), the claws 21*a*, 21*b* are released from the mounting part.

In order to supplement the behavior in the respective positions, a mandrel 23 is provided at the holding device. Upon operation of the unlocking push button 25, the unlocking lever 26 is pivoted and moves the mandrel 23 linearly. A back face 23*a* of the mandrel 23 is shaped such that when it is pushed against a corresponding face of the claws 21*a*, 21*b*, the claws 21*a*, 21*b* are tightened to the mounting part. A front surface 23*b* of the mandrel 23 is shaped such that when it is pushed against a corresponding face of the claws 21*a*, 21*b*, the claws 21*a*, 21*b* are spread open. In the shown example, the mandrel 23 pushes against rollers 24, which in turn spread the claws 21*a*, 21*b*.

In an idle state in the unlocked closed position (FIG. 5), the mandrel substantially does not touch any of the faces on the claws 21*a*, 21*b*, thus allowing a limited spatial aligning movement of the tool parts.

Figure 7:
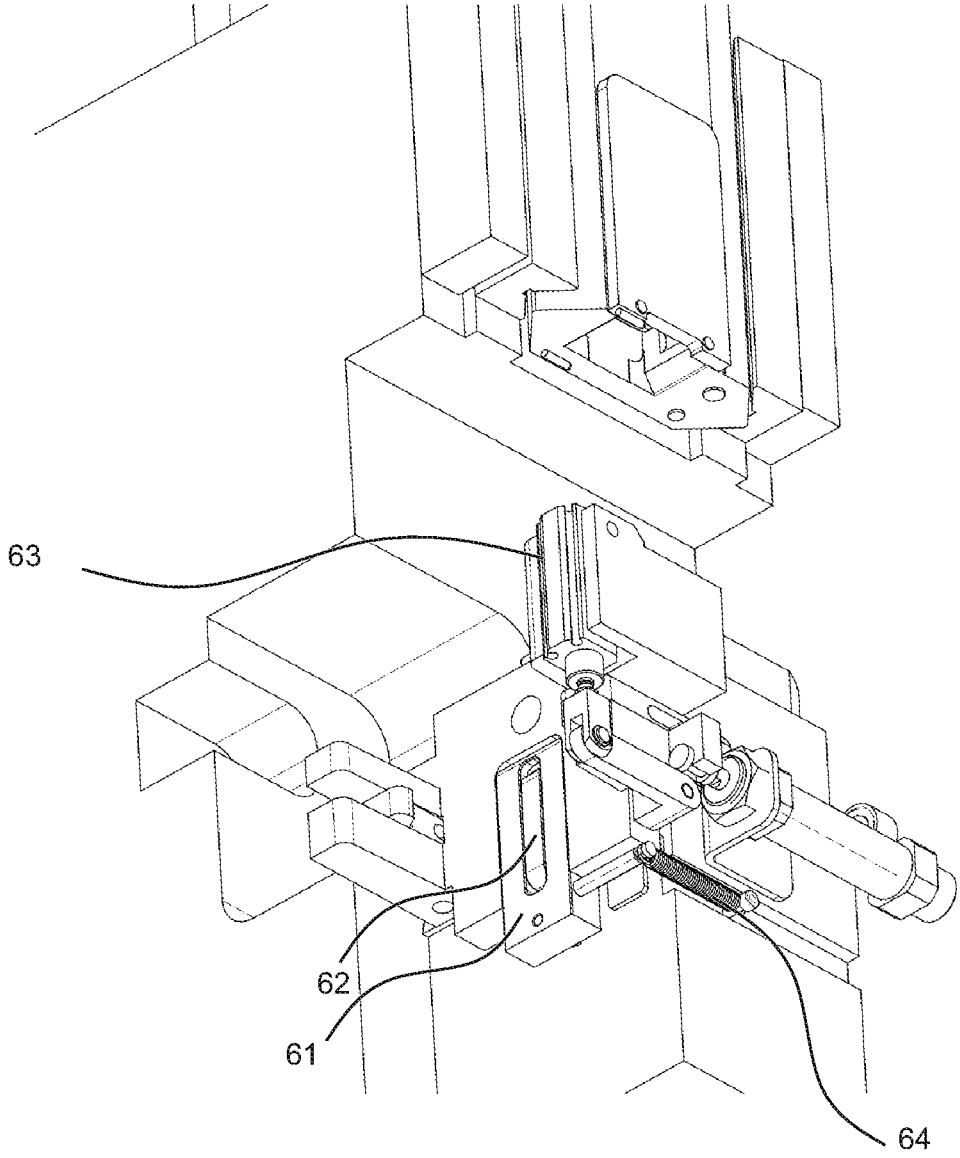
FIG. 7 is a perspective view of a locking device arranged at the crimping device.
Figure 8:
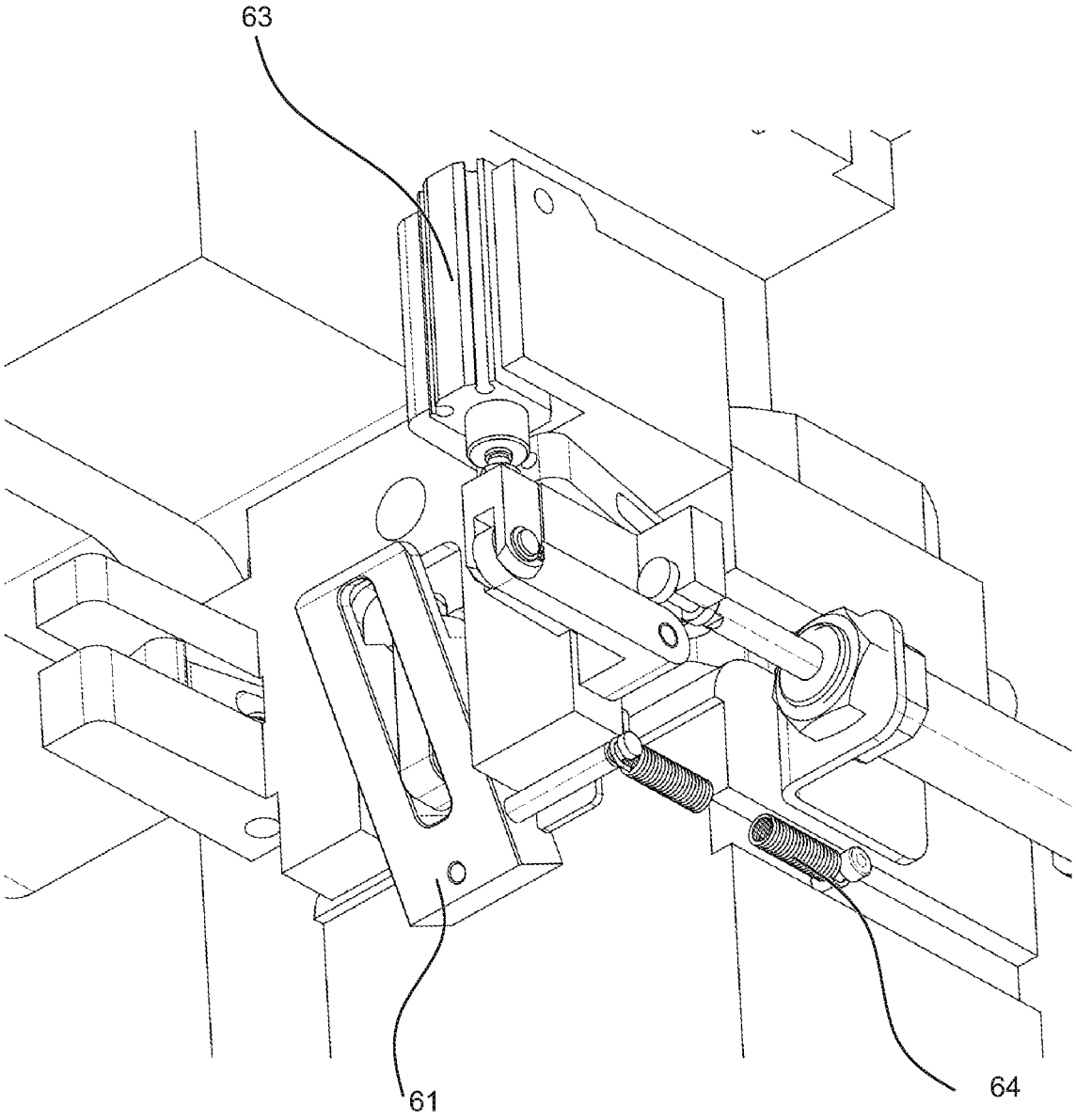
FIG. 8 is a perspective view of the locking device of FIG. 7 in a state of a lever operation.
Figure 9:
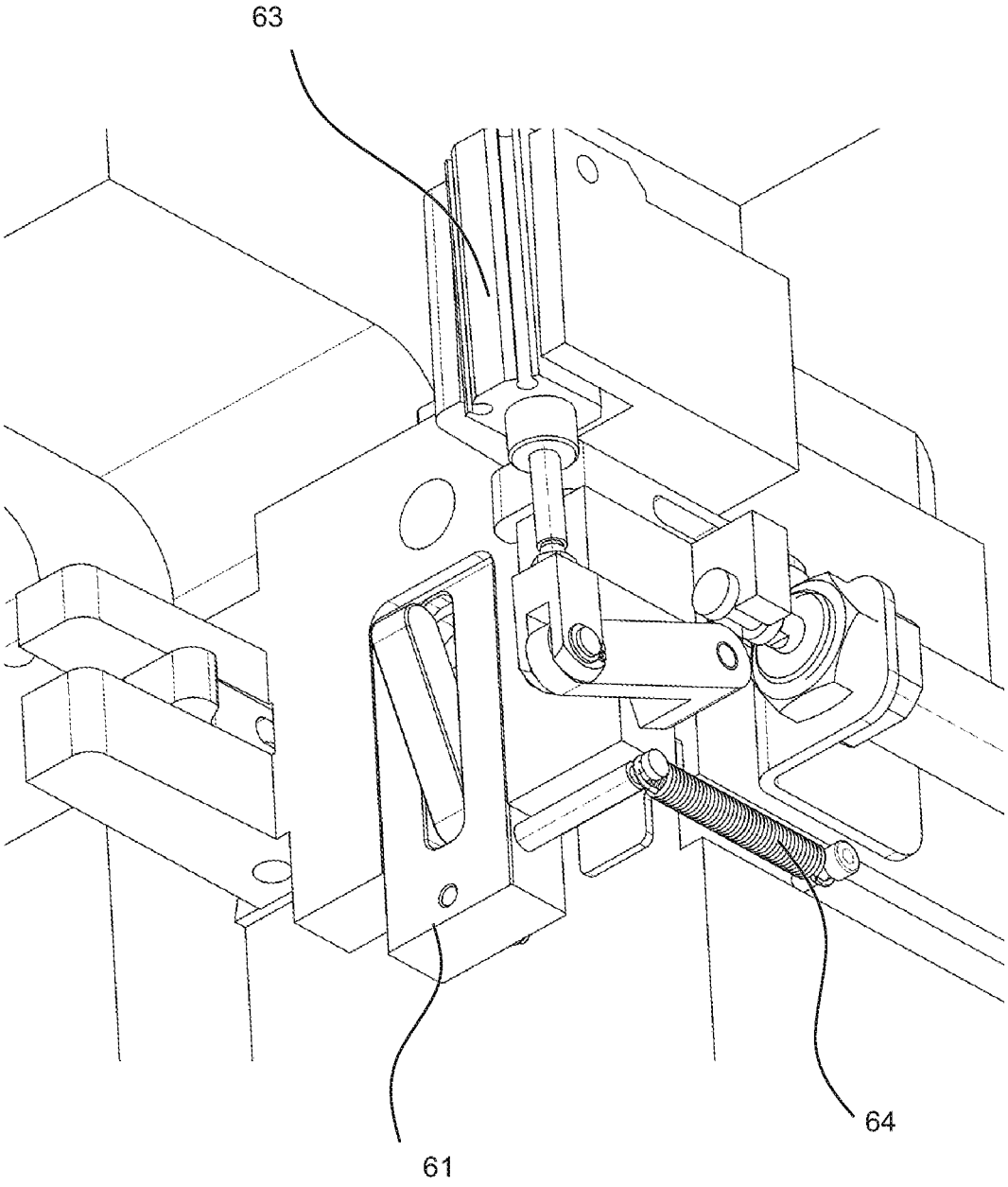
FIG. 9 is a perspective view of the locking device of FIG. 7 in a state of an opening lever operation.

In the perspective view of FIG. 7, the locking device is shown. The locking device comprises, in addition to parts for attaching to the crimping cassette 10, elements for unlocking and opening the claws. A lever 61 is passively pivoted by a pulling force of a spring 64 at a time where the locking device is moved out as a whole (FIG. 8). Independent from the operation of the lever 61, an opening lever 62 may be actuated by a pneumatic cylinder 63 (FIG. 9).

Both the lever 61 and the opening lever 62 act on the unlocking push button 25 of the holding device. The unlocking push button 25 is then flush with the housing of the crimping cassette 10 and cannot be pushed in to such an extent that the claws 21*a*, 21*b* are opened entirely.

Figure 10:
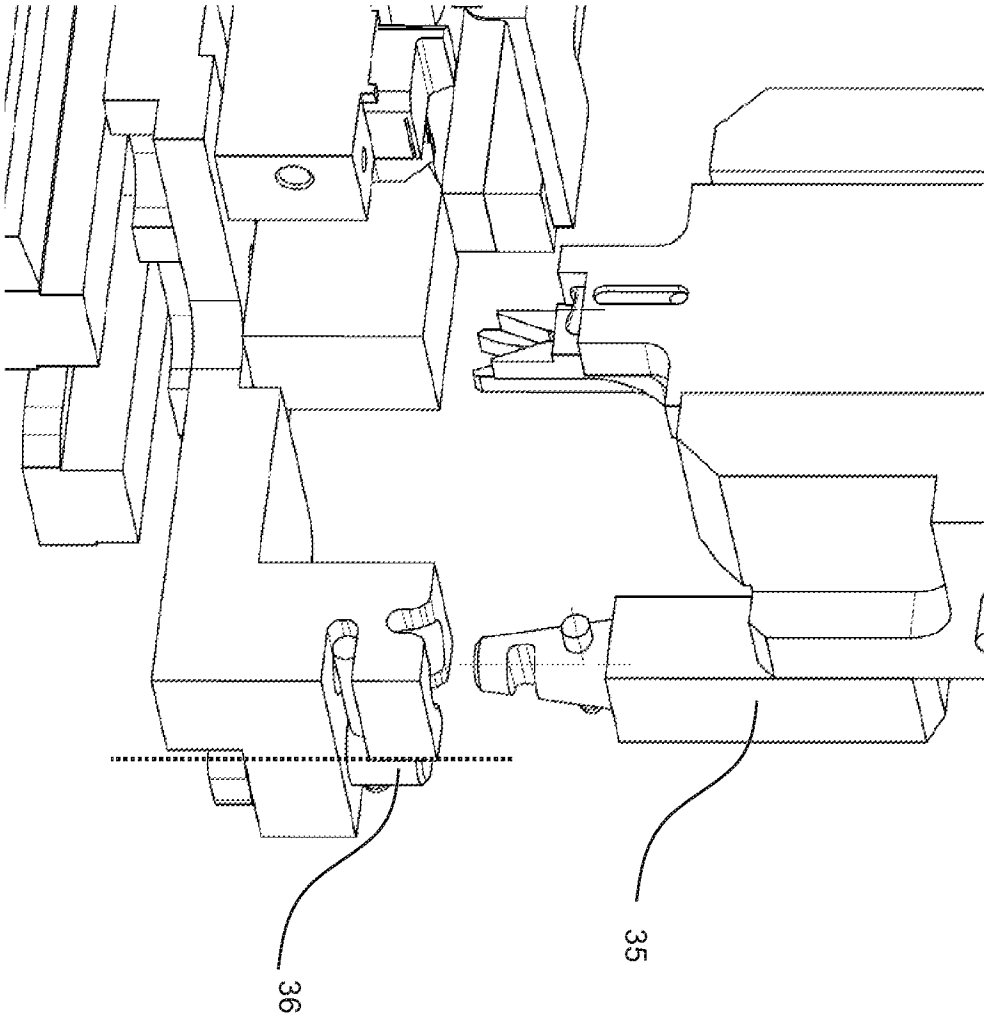
FIG. 10 is a perspective view of a coupling device arranged at the crimping device.

FIG. 10 is a perspective view of a coupling device 35 arranged at the crimping device. In FIG. 10, the coupling device 35 is fixed at the movable tool part and comprises a conical end face which is adapted to be engaged with a corresponding conical bore provided on the stationary tool part. A latch bolt 36 is provided which is pushed sidewards when the end face of the coupling device 35 is inserted into the bore. The latch bolt 36 is then reset into its initial position by a spring (not shown) and fixes the end face of the coupling device 35.

Figure 11:
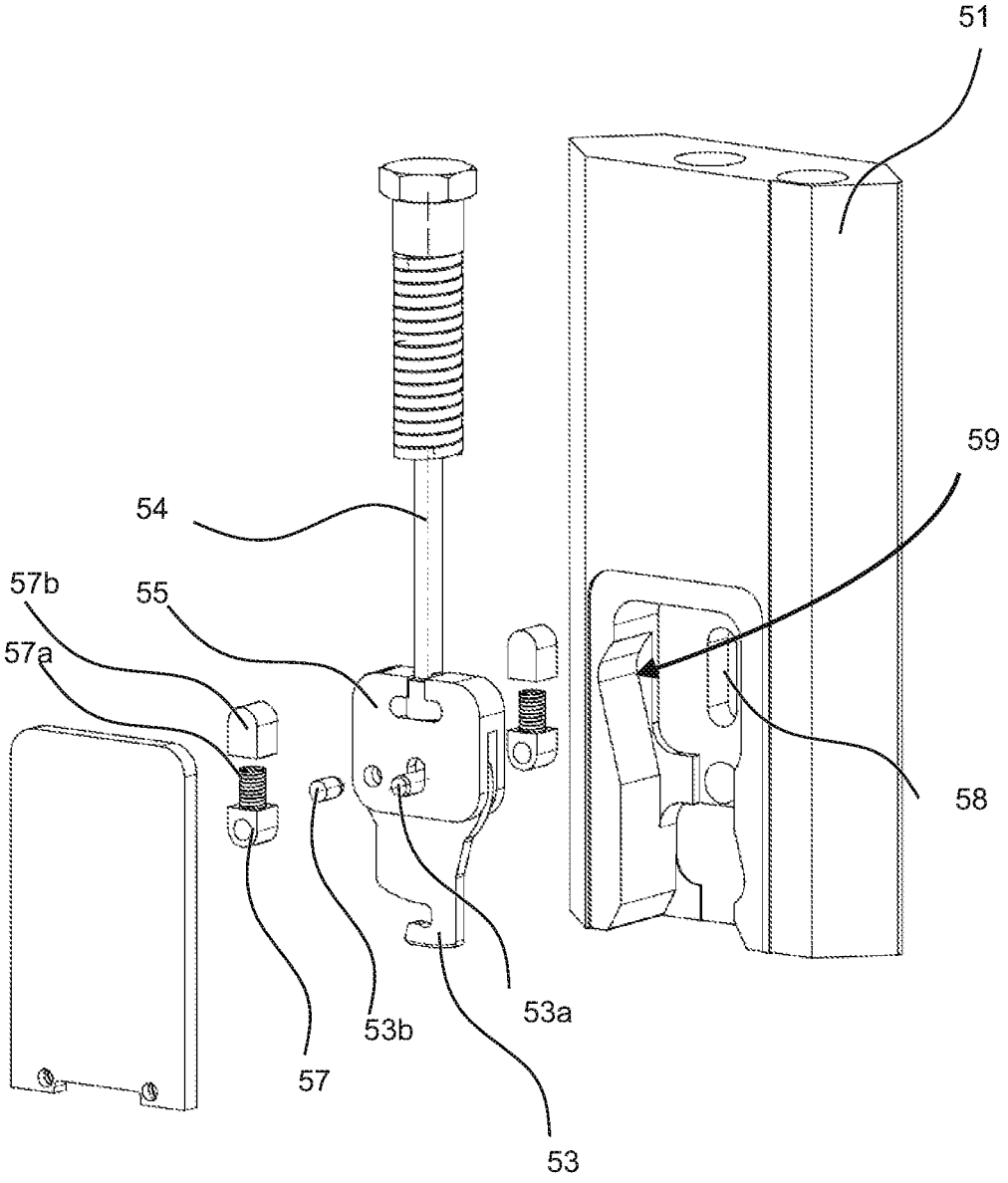
FIG. 11 is an exploded view of parts of a mounting device.

In FIG. 11, the mounting device 51 comprises a gripper 53 which is pivotable around a rotation axis 53*a*. A pulling rod 54 can be actuated by a pneumatic cylinder (not shown) which pushes the pulling rod 54, which in turn moves a yoke 55 at which the pulling rod 54 and the gripper 53 are fixed, into the downwards direction. Upon release of the pneumatic cylinder, this movement is counteracted by a push spring which pulls up the gripper 53 into an upper position.

The gripper 53 is inserted into the yoke 55 and has contact parts with two elements. The rotation axis 53*a* is one of the elements, and the rotation axis 53*a* allows for a rotational movement of the gripper 53. A bolt 53*b*, as the other one of the elements, is another contact element of the gripper 53.

Two mounting pieces each comprising a push spring and a spring holder are provided on each lateral sides of the rotation axis 53*a*. The mounting pieces are held within a groove on the mounting device 51 and allow for a slight linear movement of the gripper. A trajectory outline 59 is provided as an auxiliary measure to make sure that the gripper performs a linear movement in the first place. Under normal conditions, the gripper is not in contact with the trajectory outline 59; however, in the exemplary case that an irregular movement occurs which would lead to a rotary or pivoting movement of the gripper, the gripper is guided along the trajectory outline 59

Figure 12:
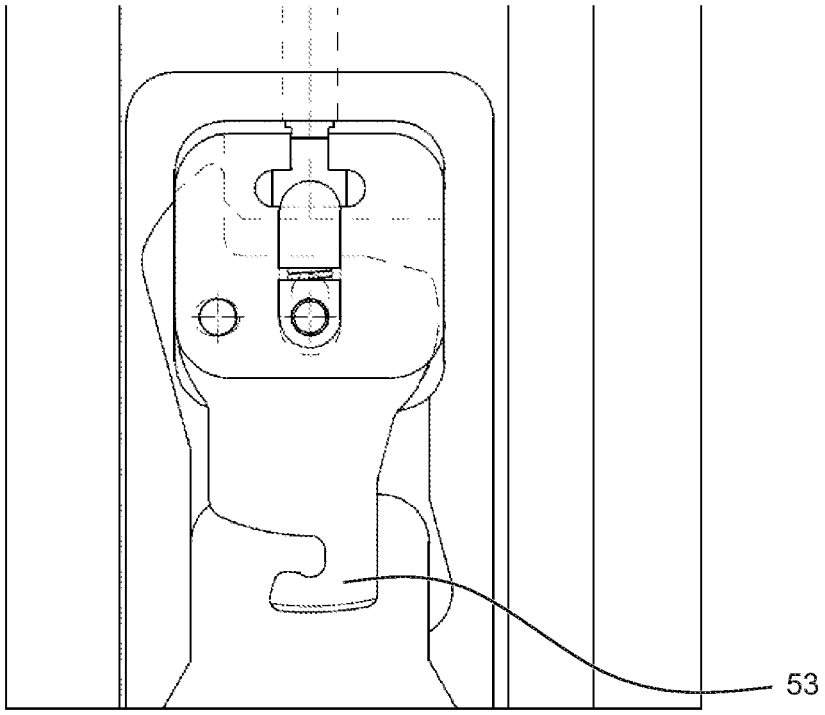
FIG. 12 is a view showing a gripper of the mounting device in an upper position.

When the pneumatic cylinder (not shown) is in its retracted position, the spring pulls the yoke 55 into the uppermost position (FIG. 12). The shape of the trajectory outline 59 prevents a pivoting movement of the gripper 53.

Figure 13:
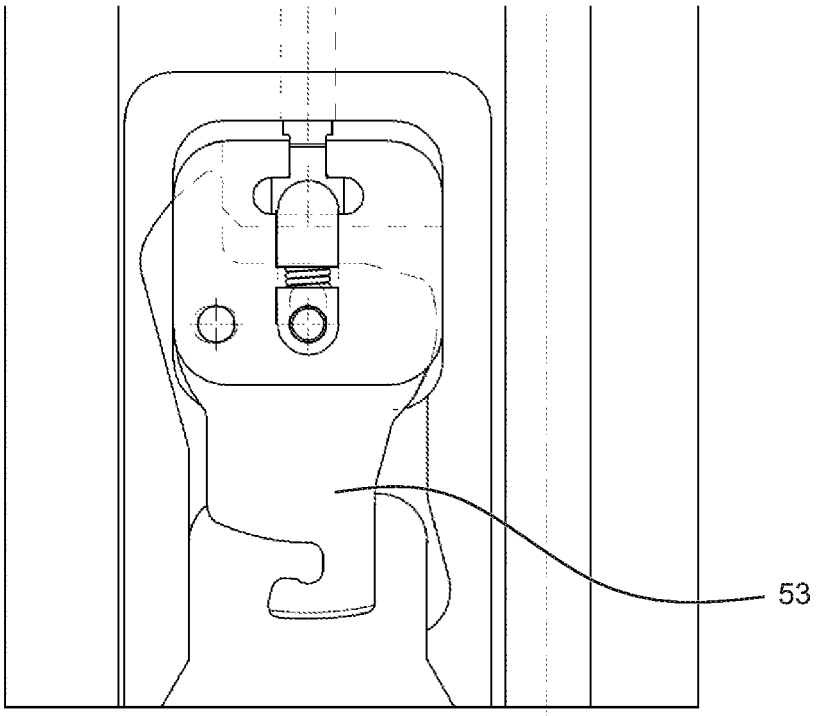
FIG. 13 is a view showing the gripper of the mounting device in an end position of linear movement.
Figure 14:
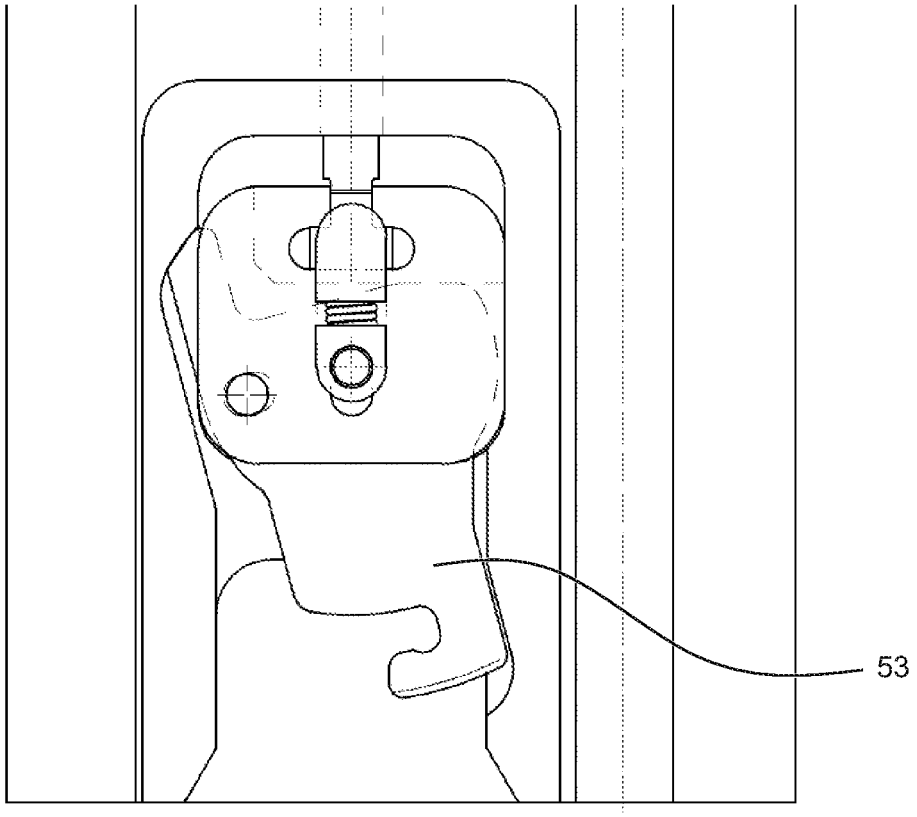
FIG. 14 is a view showing the gripper of the mounting device in an end position of pivoting movement.

Upon moving the pneumatic cylinder outwardly, the yoke 55 is moved down. In a first stage, the mounting pieces make the gripper 53 move linearly downward (FIG. 13). At the end of the first stage, the linear movement is limited by the grooves 58. Since the rotation axis 53*a* is fixed, the gripper 53 moves, along the trajectory outline 59, in a pivotal manner (FIG. 14).

Figure 15:
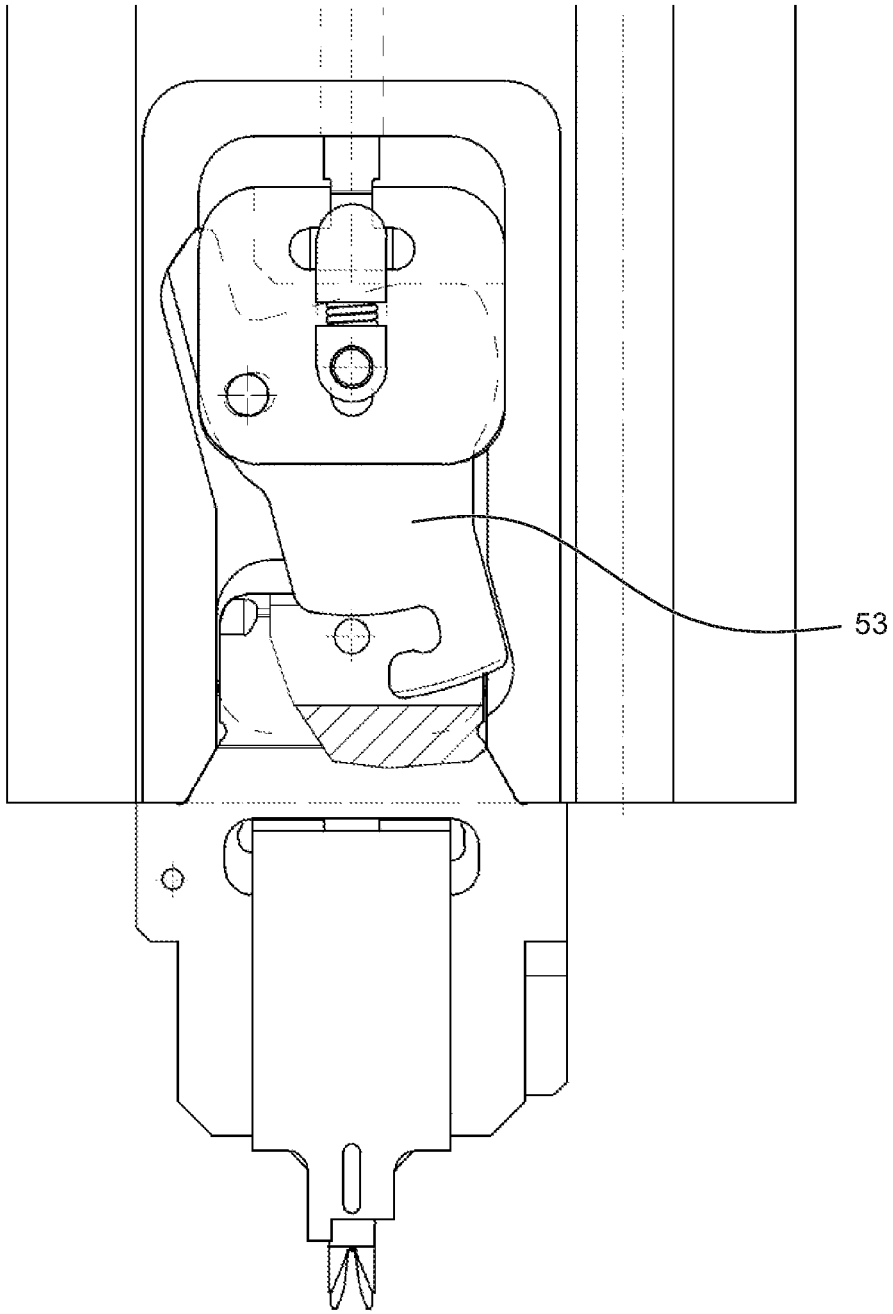
FIG. 15 shows the gripper of FIGS. 12 to 14 in a first position.
Figure 16:
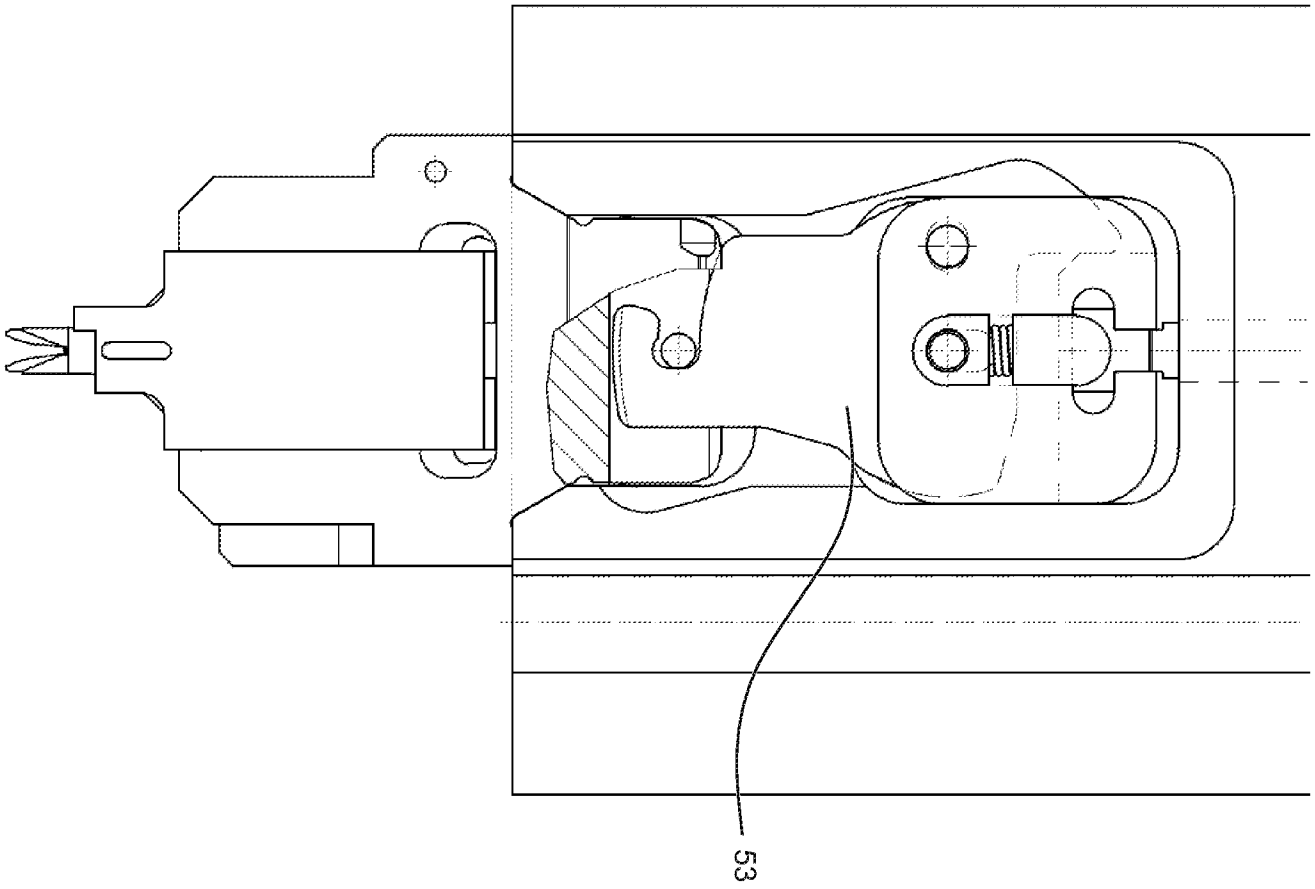
FIG. 16 shows the gripper of FIGS. 12 to 14 in a second position.
Figure 17:
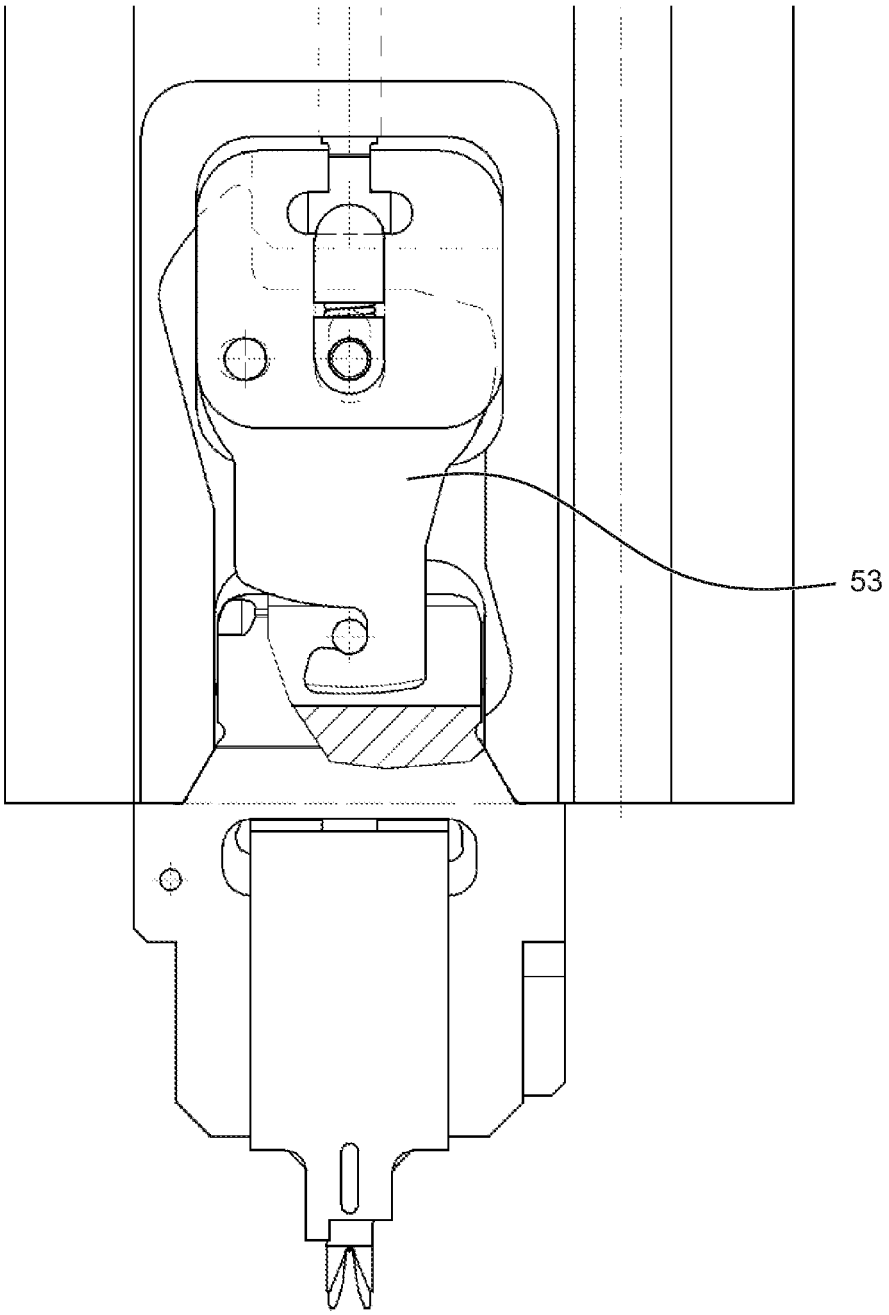
FIG. 17 shows the gripper of FIGS. 12 to 14 in a third position.

A gripping operation of the movable crimp tool part by the gripper is shown in an illustrative manner in FIGS. 15 to 17.

Figure 19:
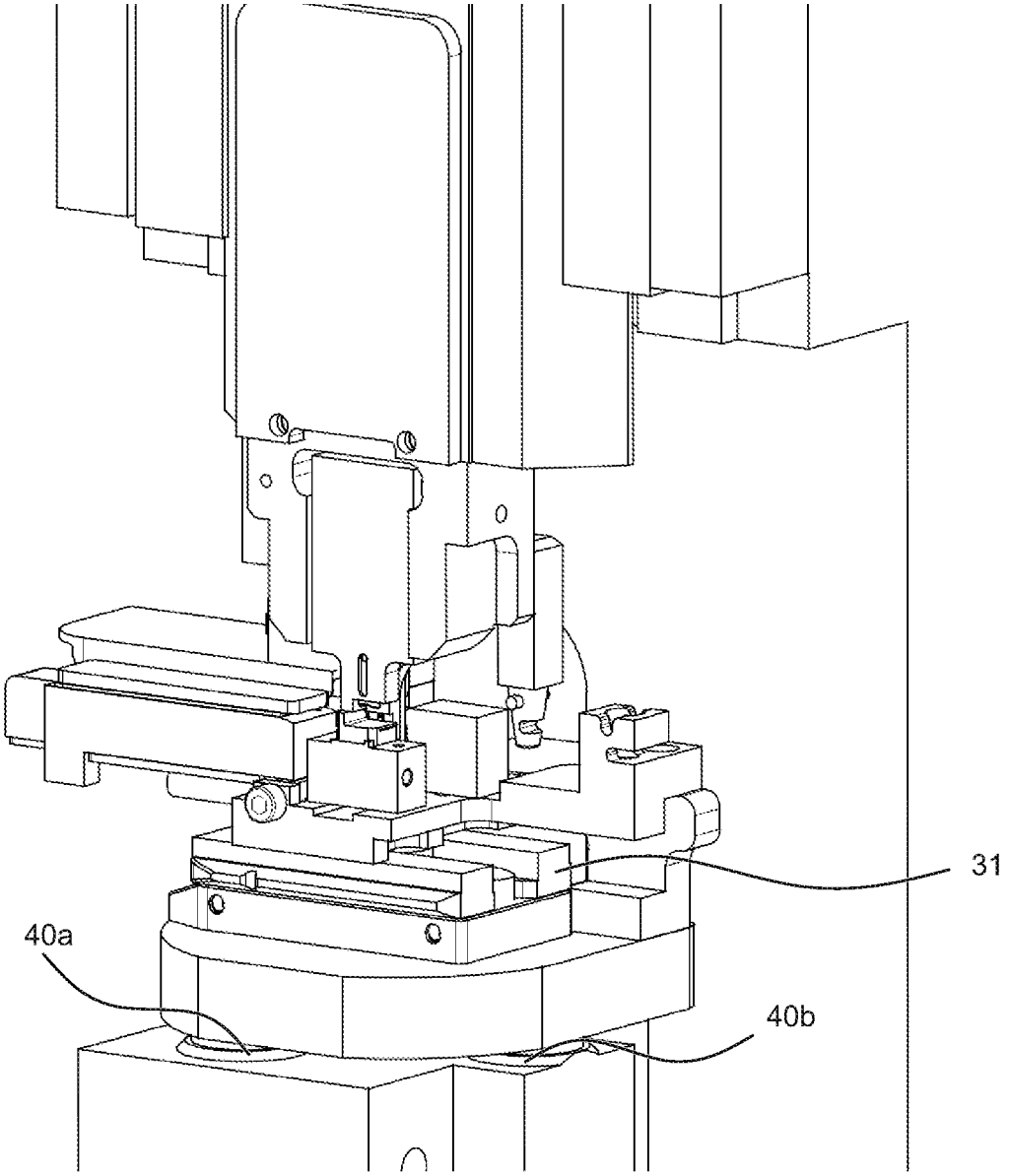
FIG. 19 is a perspective view of a crimping device during an alignment operation of the upper and lower tool parts of the crimping cassette.
Figure 20:
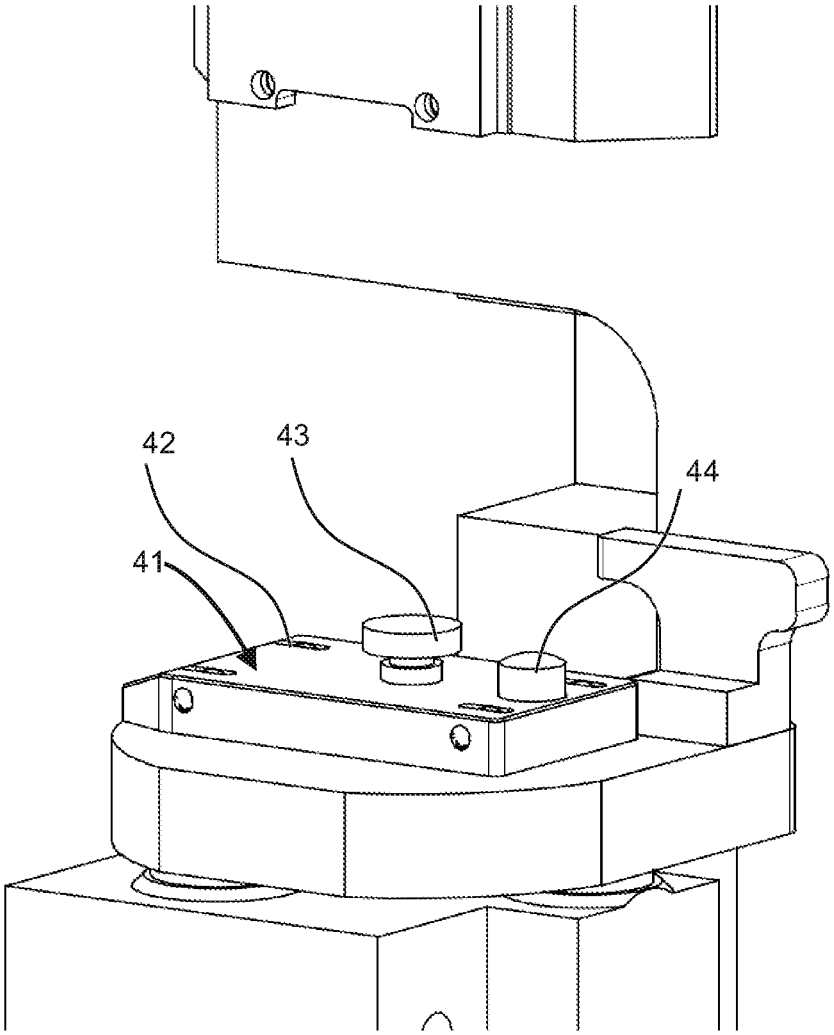
FIG. 20 is a close-up perspective view of parts of FIG. 19.
Figure 21:
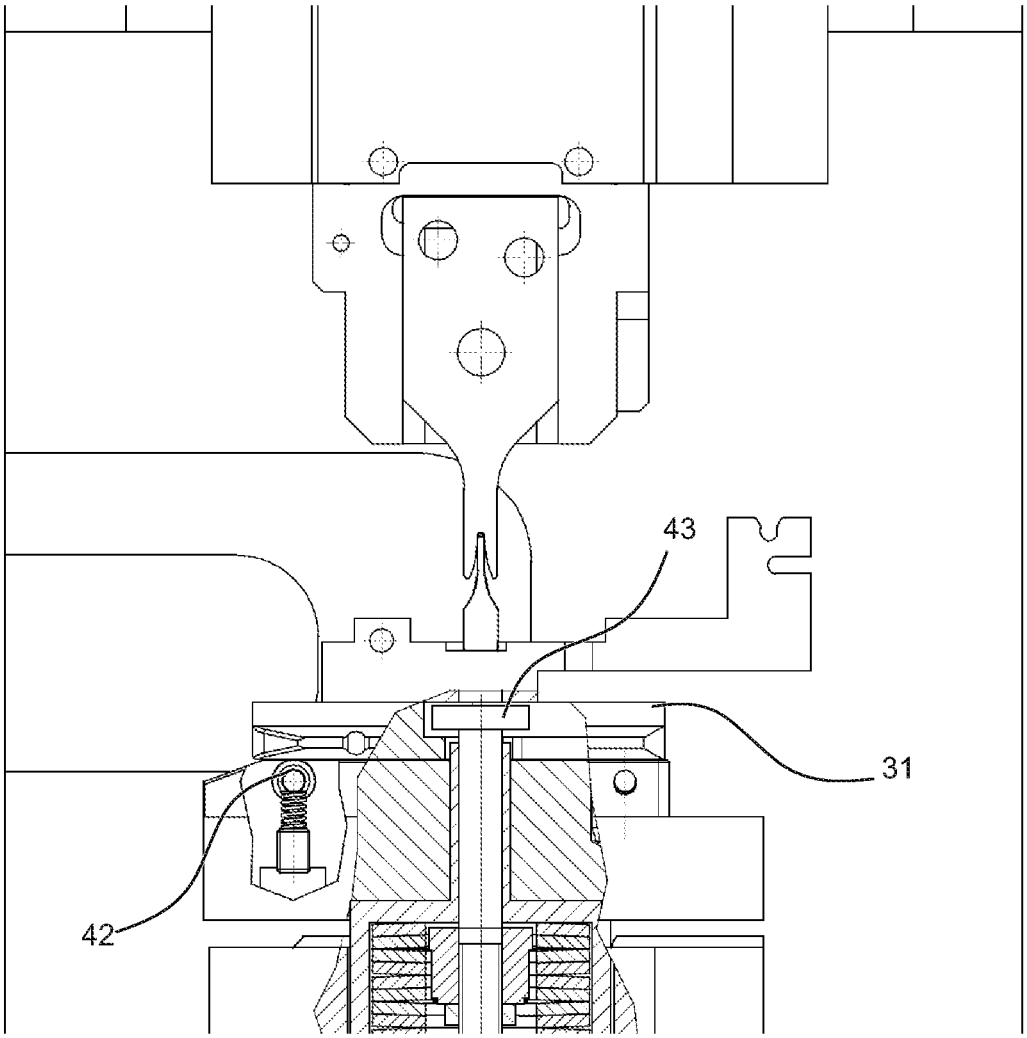
FIG. 21 is a sectional side view of the crimping device of FIG. 19 during the alignment operation.

FIGS. 19 to 21 show a crimping press during alignment of the movable and stationary tool parts. The base plate 31 is provided with pressure sensors 40*a*, 40*b*. In the shown example, a third pressure sensor is provided but not shown in FIGS. 19 to 21. The disclosure is not limited to a particular amount of pressure sensors 40*a*, 40*b*, and in general, one, two, three, or more pressure sensors 40*a*, 40*b* can be provided, dependent on the constructive measures and/or a desired accuracy. The pressure sensors 40*a*, 40*b* help to detect when the crimp anvil and the crimp indentor touch each other and prevent an excessive pressure from being exerted to the crimp anvil and the crimp indentor.

On an attachment surface 41 of the base plate 31, supporting rollers 42 are provided to lower a friction between a mounting part and the attachment surface 41. In the shown example, the mounting part comprises a clamping element 43 and mounting cylinders 44. The supporting rollers 42 are optional parts and may be omitted; in particular, when using crimping contacts having a certain minimum size, the alignment may be performed without supporting rollers 42.

In an unloaded state, the supporting rollers 42 protrude slightly from the attachment surface 41 in the shown example. A spring mechanism (not shown) bears the supporting rollers 42 such that each of the supporting rollers 42 may be pressed downwards by a load acting thereon, i. e. to be at least flush with the plane of the attachment surface 41 in the case of a sufficient load. Thereby, the stationary tool part rests entirely on the attachment surface 41 and is virtually unaffected by the supporting rollers 42.

For performing an alignment operation, the clamping element 43 is loosened, then the stationary tool part is inserted. Then, the movable tool part is lowered, and the alignment surfaces of the crimp anvil and the crimp indentor touch each other. This operation is monitored using the pressure sensors 40*a*, 40*b*. Depending on the applied forces, the optional supporting rollers 42 are pushed downwards, to make the stationary tool part rest entirely on the attachment surface 41. After the alignment is performed, the clamping element 43 is tightened.

FIGS. 22-28 show different stages of a loading operation of the crimping cassette 10 in a crimping device of a cable processing apparatus.

Figure 22:
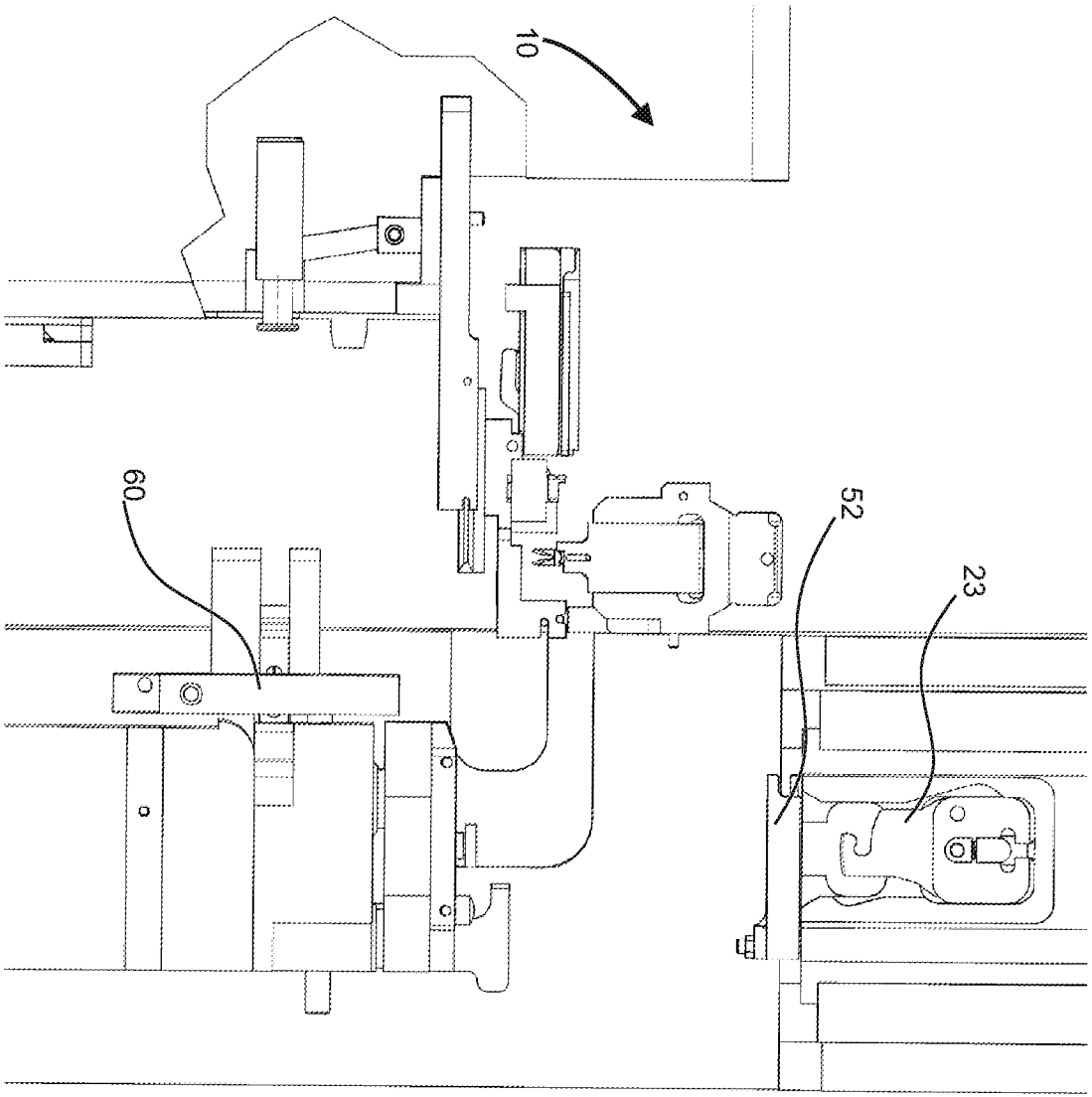
FIG. 22 is a sectional side view showing a stage of a loading operation of a crimping cassette in a crimping device of a cable processing apparatus.
Figure 23:
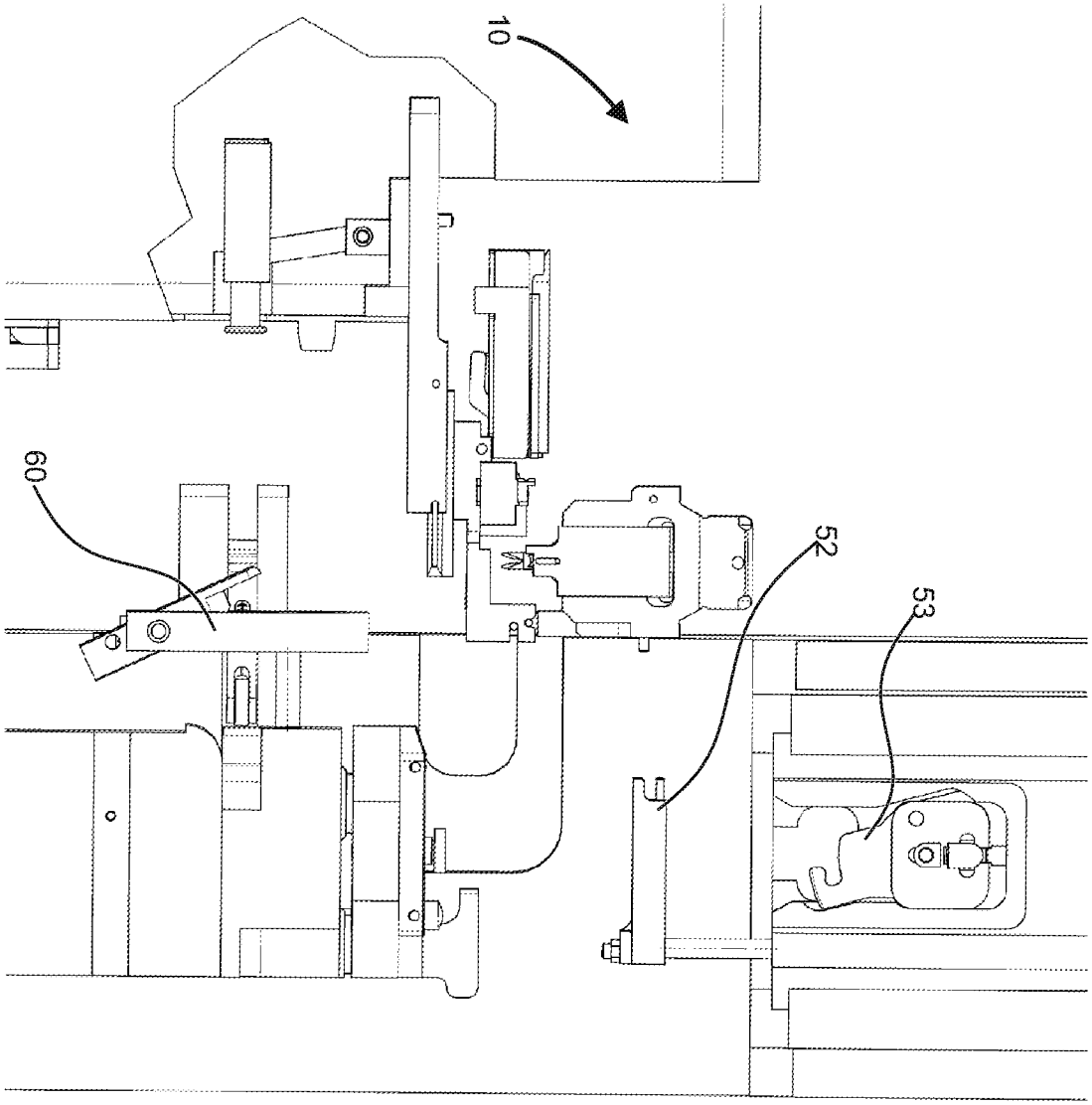
FIG. 23 is a sectional side view showing another stage of the loading operation of the crimping cassette in the crimping device of a cable processing apparatus.

In FIG. 22, the cassette 10 is in an initial position. In FIG. 23, the locking device of the crimping device moves outward, and the gripper 53 is opened. If present, the lifting fork 52 is lowered.

Figure 24:
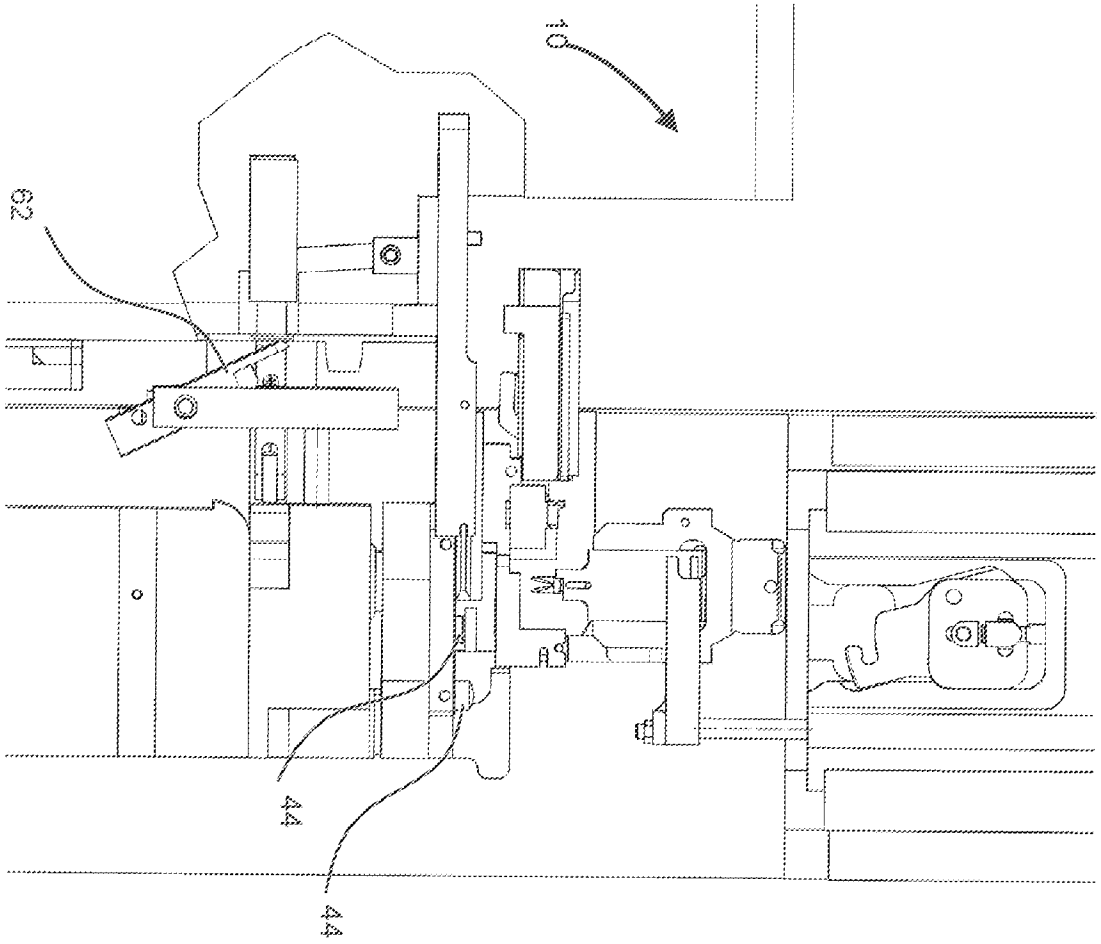
FIG. 24 is a sectional side view showing another stage of the loading operation of the crimping cassette in the crimping device of a cable processing apparatus.

In FIG. 24, the cassette 10 is moved to the right, and the unlocking push button 25 is operated. The stationary tool part can be aligned relative using the mounting cylinders 44. In the shown example, the alignment is performed by an aligning movement of a slit in the base plate 31 relative to a periphery of the mounting cylinder 44 and, in addition, relative to a periphery of the mounting cylinder below the clamping element 43 (cf. FIG. 20).

Figure 25:
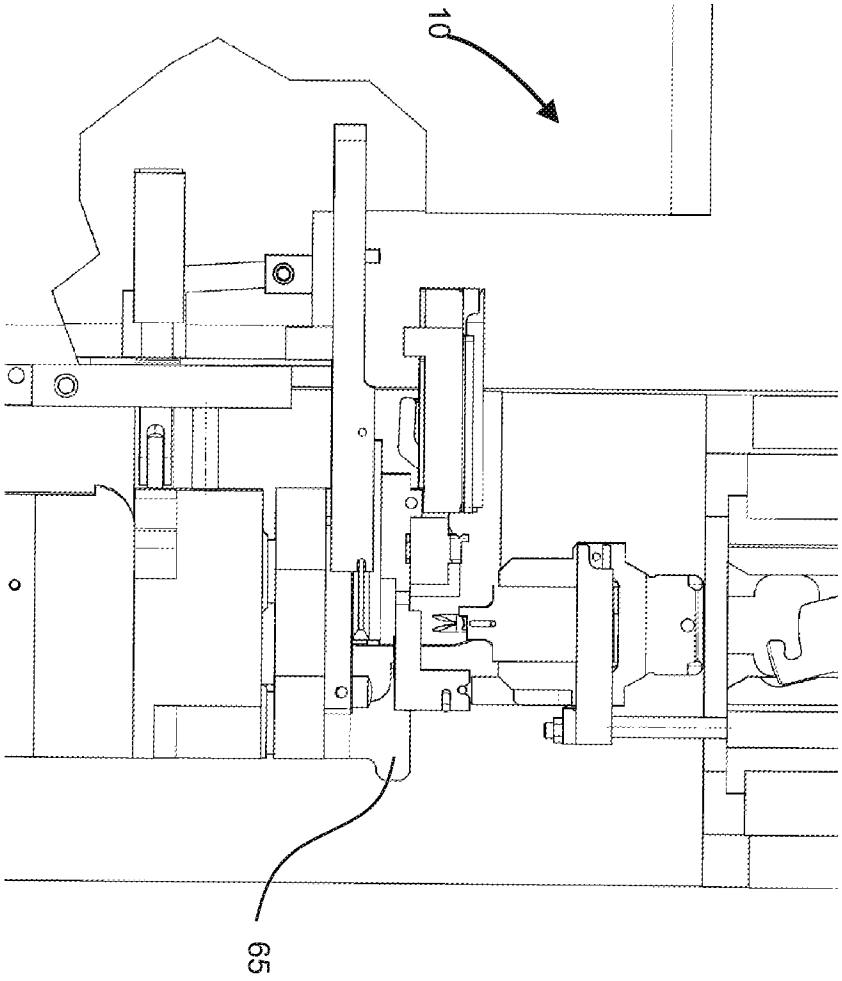
FIG. 25 is a sectional side view showing yet another stage of the loading operation of the crimping cassette in the crimping device of a cable processing apparatus.

In FIG. 25, the movable tool part has been moved to the mounting device 51, and the cassette is moved further to the right. The coupling is open since the latch bolt 36 has been operated by an abutment 65.

Figure 26:
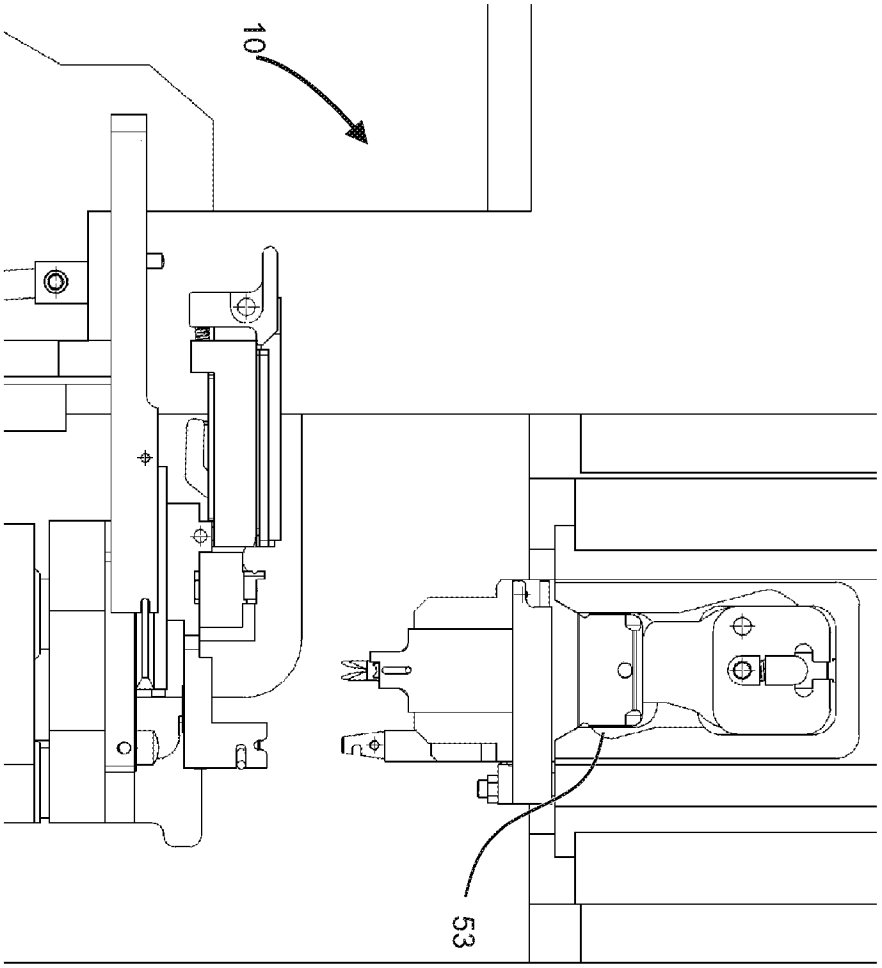
FIG. 26 is a sectional side view showing yet another stage of the loading operation of the crimping cassette in the crimping device of a cable processing apparatus.

In FIG. 26, the movable tool part is gripped by the gripper 53. Thereafter, the moveable tool part is lifted, through the lifting fork 52, to the mounting device 51. In an alternative embodiment without a lifting fork 52, the mounting device 51 is lowered towards the moveable tool part. In either case, the movable tool part is moved relative to the mounting device 51, such that the movable tool part and the mounting device 51 approach each other.

Figure 27:
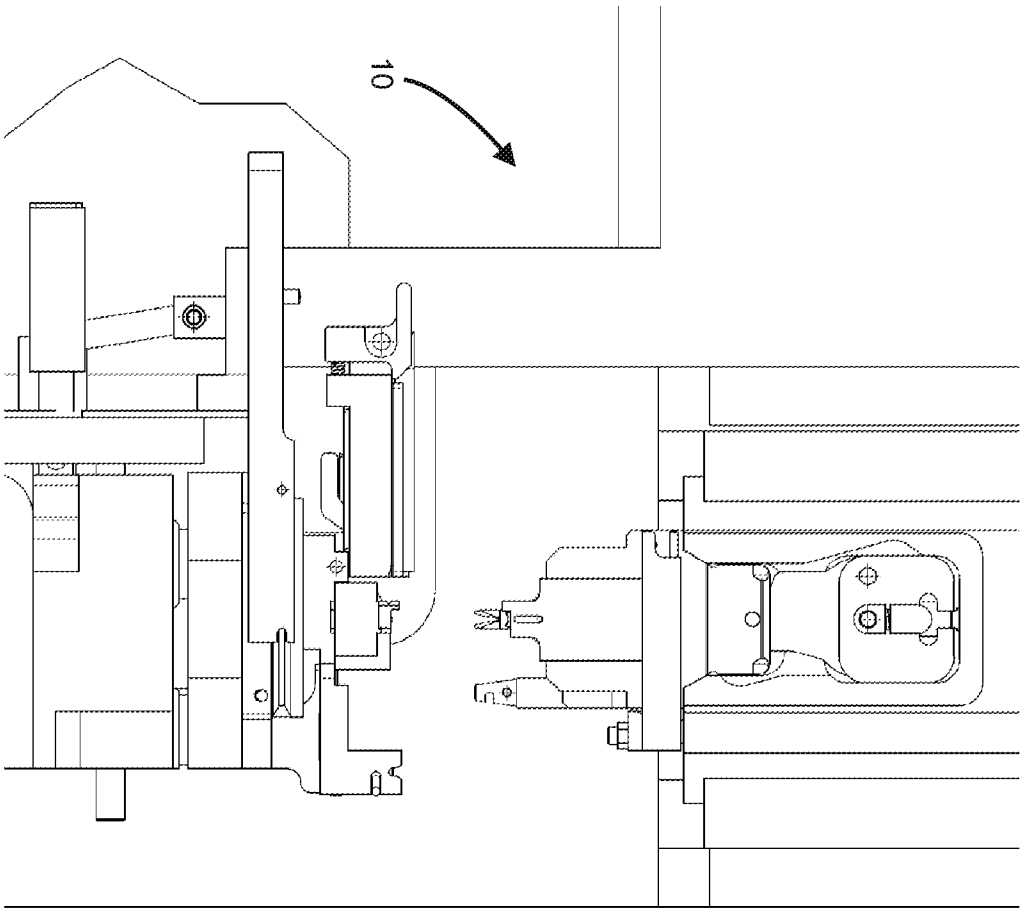
FIG. 27 is a sectional side view showing yet another stage of the loading operation of the crimping cassette in the crimping device of a cable processing apparatus.
Figure 28:
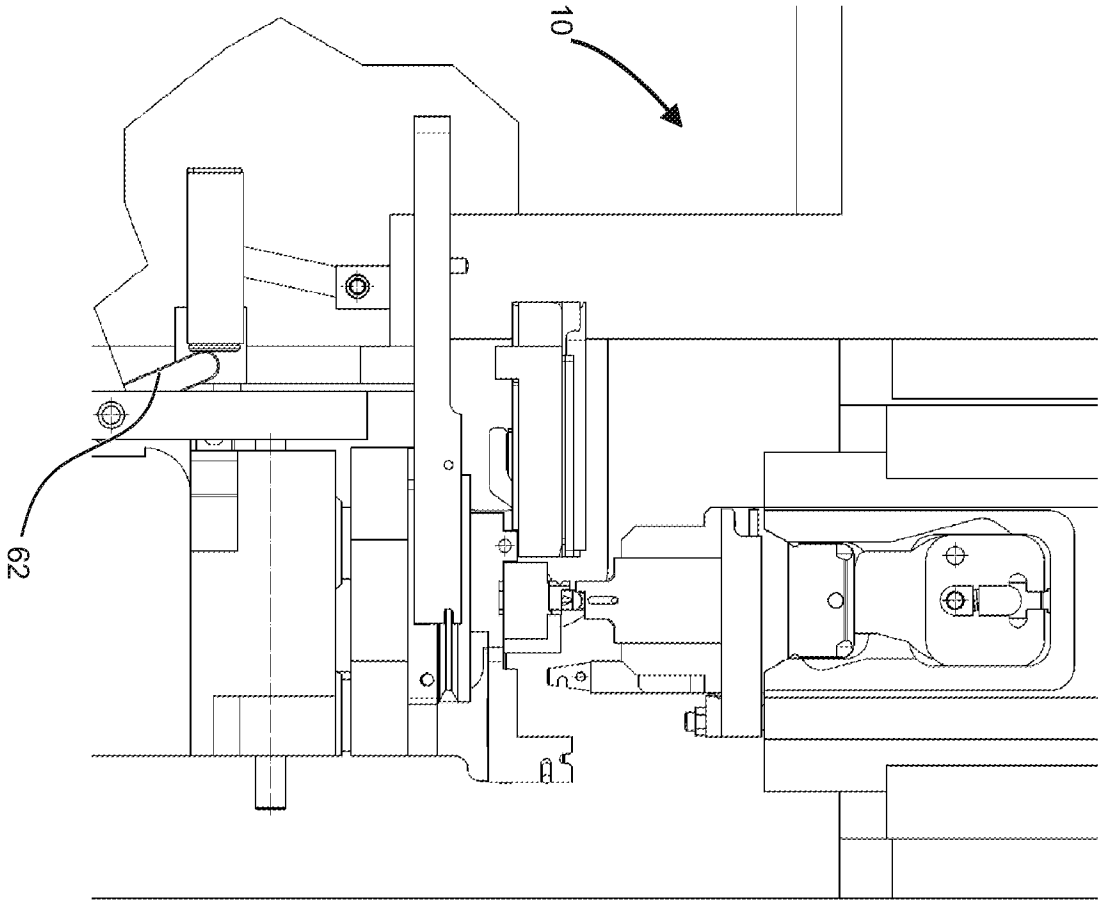
FIG. 28 is a sectional side view showing yet another stage of the loading operation of the crimping cassette in the crimping device of a cable processing apparatus.

Subsequently, the locking device is moved inwards, the cassette 10 is further moved to the right and clamped, and the movable tool part is lowered (FIG. 27). Then the claws 21*a*, 21*b* are opened by pivoting the opening lever (FIG. 28), whereby the stationary tool part is released.

Subsequently, the above-described alignment process may be performed.

Although the invention has been described on the basis of some preferred embodiments, those skilled in the art should appreciate that those embodiments should by no way limit the scope of the present invention.

What is claimed is:

1. A method of aligning a crimping tool of a crimping cassette in a cable processing apparatus, wherein the crimping cassette (10) comprises the crimping tool having a stationary tool part and a movable tool part, wherein the crimping cassette (10) further comprises a holding device for attaching to a mounting part, the mounting part being directly or indirectly fixed to the stationary tool part, wherein the holding device has a position allowing for an adjustment movement of the stationary tool part within a spatially limited adjustment range, wherein the cable processing apparatus comprises a tensioning device for the mounting part adapted to apply a tensioning force to the mounting part relative to an attachment surface provided on the crimping device, wherein the method comprises:

releasing the tensioning device;

inserting the stationary tool part of the crimping tool into a tensioning area of the tensioning device;

moving the moveable tool part towards the stationary tool part slightly before the moveable tool part touches the stationary tool part;

moving the moveable tool part towards the stationary tool part until a pressing force between the moveable tool part and the stationary tool part is reached or exceeded, such that an alignment within the adjustment range takes place between the moveable tool part and the stationary tool part; and applying a tension with the tensioning device.

2. The method according to claim 1, wherein the holding device comprises at least two claws (21*a*, 21*b*) for attaching to the mounting part in a mounting area of the claws (21*a*, 21*b*).

3. The method according to claim 2, wherein the position allowing an adjustment movement of the stationary tool part within a spatially limited adjustment range is an unlocked closed position, and wherein the holding device further has a locked closed position in which the claws (21*a*, 21*b*) are firmly clamped to the mounting part, and an open position in which the claws (21*a*, 21*b*) release the mounting part such that the stationary tool part is separable from the holding device, wherein the method further comprises:

before releasing the tensioning device: bringing the holding device in the unlocked closed position;

before moving the moveable tool part towards the stationary tool part until a pressing force between the moveable tool part and the stationary tool part is reached or exceeded, such that an alignment within the adjustment range takes place between the moveable tool part and the stationary tool part: bringing the holding device into the open position.

4. The method according to claim 1, wherein the crimping cassette (10) further comprises an operating device adapted to operate the holding device at least between the locked closed position and the unlocked closed position.

5. The method according to claim 1, wherein the cable processing apparatus comprises a crimping device and a locking device, wherein the stationary and movable tool parts of the crimping cassette (10) are configured to act together in a crimping operation of the crimping device of the cable processing apparatus, wherein the locking device is configured to operate the operating device of the crimping cassette for releasably locking the crimping cassette, wherein the cable processing apparatus further comprises a mounting device configured to mount the moveable tool part of the crimping tool of a loaded crimping cassette, wherein the mounting device comprises a gripper which is configured and arranged to be moveable according to a gripping trajectory to grip a gripping counterpart of the moveable tool part, wherein the method further comprises:

moving the locking device towards the crimping cassette (10) to be loaded;

operating the operating device to bring the holding device into the unlocked closed position;

attaching the crimping cassette to the locking device;

releasing the moveable tool part from the stationary tool part;

moving the moveable tool part relative to the mounting device such as to approach the moveable tool and the mounting device; and gripping the gripping counterpart of the moveable tool part.

6. The method according to claim 1, wherein in the crimping cassette (10), a closing spring is provided and arranged such as to close the gripping of the claws in the unlocked closed position.

7. The method according to claim 1, wherein in the unlocked position of the holding device, the spatially limited adjustment range is substantially in a plane which is perpendicular to a crimping operation movement of the movable tool part relative to the stationary tool part.

8. The method according to claim 1, further comprising:

when the holding device is in the unlocked closed position, moving the movable tool part towards the stationary tool part to a greater extent than when performing a crimping operation such as to mechanically shift the stationary tool part within the spatially limited adjustment range.

9. The method according to claim 1, wherein the holding device further comprises a mandrel having:

a back face shaped such that when it is pushed against a corresponding face of the claws (21*a*, 21*b*), the claws (21*a*, 21*b*) are tightened, in the mounting area, to the mounting part, a front face shaped such that when it is pushed against a corresponding face of the claws, the claws are spread, the method further comprising:

moving the mandrel into an idle state in which none of the back face or the front face pushes against the claws to facilitate a tool part alignment operation in the unlocked closed position of the holding device.

10. The method according to claim 1, wherein the crimping tool further comprises a coupling device, wherein the method further comprises releasably coupling the movable tool part with the stationary tool part.

11. The method according to claim 1, wherein the gripping trajectory comprises, in a movement of the gripper to grip the gripping counterpart, a linear trajectory and a subsequent pivoting trajectory.

12. The method according to claim 11, wherein the gripper is arranged and shaped such as to be moved according to the gripping trajectory upon applying a force to an operating face of the gripper, the force having a constant direction throughout the movement of the gripper according to the gripping trajectory.

13. The method according to claim 1, wherein the cable processing apparatus further comprises an actuator, wherein the method further comprises opening the gripper by operating the pneumatic cylinder.

14. The method according to claim 1, wherein the cable processing apparatus further comprises a lifting device, wherein the method further comprises lifting the moveable tool part towards the mounting device.

15. The method according to claim 1, wherein the cable processing apparatus further comprises a pressure detector arranged to detect a pressing force between the movable tool part and the stationary tool part, and a stroke limiting device connected to the pressure detector, wherein the method further comprises:

limiting, via the stroke limiting device, a stroke of the movable tool part relative to the stationary tool part upon detection of a pressing force which exceeds a predetermined maximum pressing force.

16. The method according to claim 1, wherein the crimping cassette (10) further comprises an unlocking push button (25) coupled to an unlocking lever (26) as the operating device operable to release the claws (21*a*, 21*b*), wherein the locking device of the cable processing apparatus further comprises a lever (61) passively pivoted by a tensioning force of a spring (64) at a time where the locking device is moved out as a whole, and wherein the locking device of the cable processing apparatus further comprises an opening lever actuable by a pneumatic cylinder (63) as an actuator.

* * * * *